US005866833A

United States Patent [19]

Wakuda et al.

[11] Patent Number: 5,866,833

[45] Date of Patent: Feb. 2, 1999

[54] AUTOMATIC PERFORMANCE SYSTEM

[75] Inventors: Sadamoto Wakuda, Shizuoka; Ichiro Matsuda, Hamamatsu, both of Japan

[73] Assignee: Kawai Musical Inst. MFG. Co., Ltd., Shizuoka, Japan

[21] Appl. No.: 656,787

[22] Filed: May 31, 1996

[30] Foreign Application Priority Data

| | | | |
|---|---|---|---|
| May 31, 1995 | [JP] | Japan | 7-134055 |
| May 31, 1995 | [JP] | Japan | 7-134056 |
| Jun. 7, 1995 | [JP] | Japan | 7-140950 |
| Jun. 7, 1995 | [JP] | Japan | 7-140951 |
| Jun. 7, 1995 | [JP] | Japan | 7-140952 |

[51] Int. Cl.[6] ..... G10H 1/26; G10H 1/36

[52] U.S. Cl. ..... 84/609; 84/610; 84/634; 84/649; 84/650

[58] Field of Search ..... 84/602, 604–607, 84/609–612, 622–625, 634–636, 649–652, 659–661

[56] References Cited

U.S. PATENT DOCUMENTS

| | | | |
|---|---|---|---|
| 5,286,910 | 2/1994 | Hasebe | 84/609 |
| 5,367,121 | 11/1994 | Yanase | 84/666 |
| 5,600,082 | 2/1997 | Torimura | 84/610 |

*Primary Examiner*—Jonathan Wysocki
*Assistant Examiner*—Marlon T. Fletcher

[57] ABSTRACT

Automatic play progresses automatically with each sound generating operation based on timing data that indicates the timing for sounding a tone. In this manner, performance information for time count automatic play can be used with one-step automatic play. In addition, the information based on the tone generation operation for one-step automatic play and the information based on the sound generating operation for manual play are assigned to tone generating channels, which enables one-step automatic play and manual play to be performed together (in soli). Also, whether or not one-step automatic play is performed can be selected for each respective performance part or instrumental part.

32 Claims, 13 Drawing Sheets

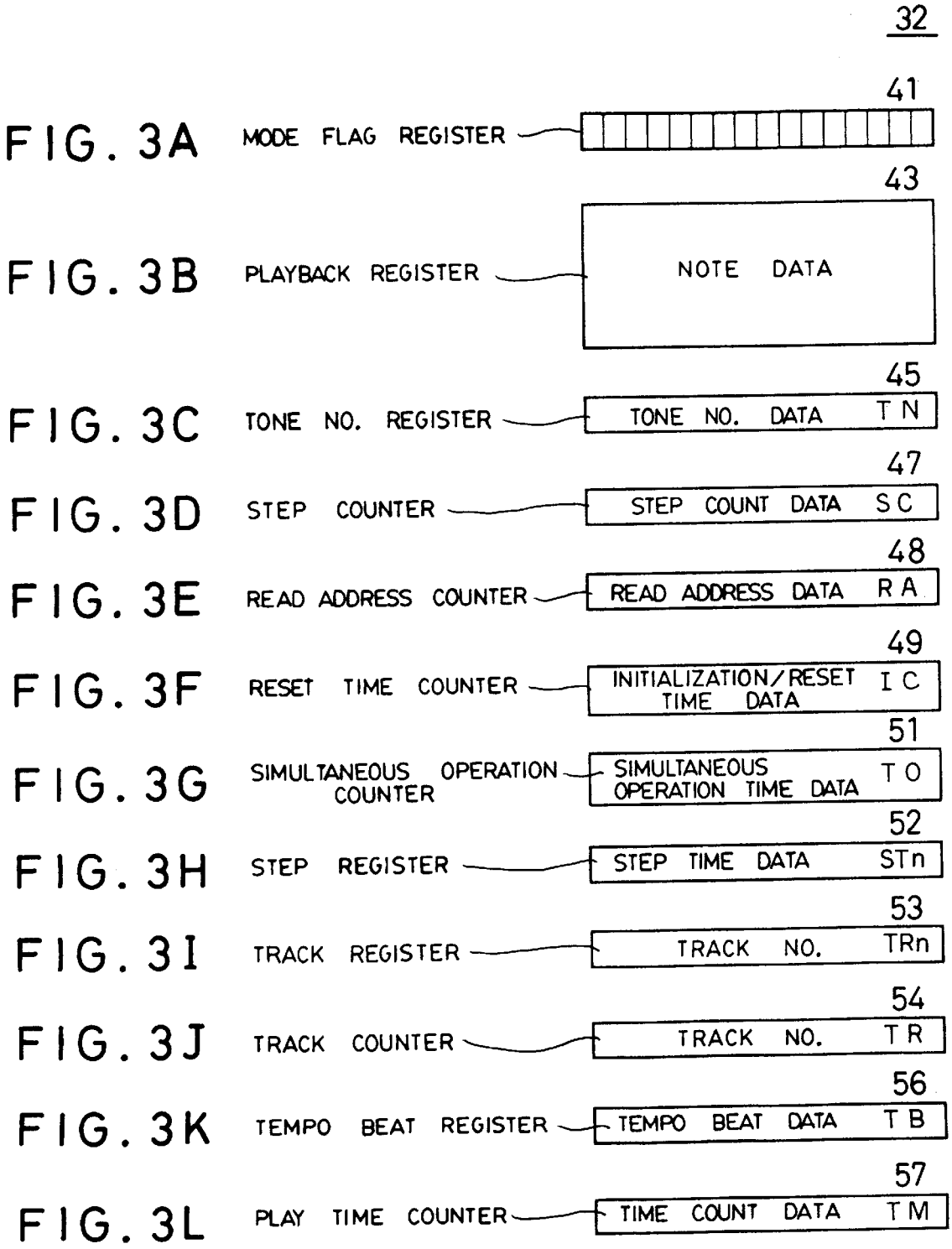
32
41
FIG. 3A
MODE FLAG REGISTER
43
FIG. 3B
PLAYBACK REGISTER
NOTE DATA
45
FIG. 3C
TONE NO. REGISTER
TONE NO. DATA
TN
47
FIG. 3D
STEP COUNTER
STEP COUNT DATA
SC
48
FIG. 3E
READ ADDRESS COUNTER
READ ADDRESS DATA
RA
49
FIG. 3F
RESET TIME COUNTER
INITIALIZATION/RESET TIME DATA
IC
51
FIG. 3G
SIMULTANEOUS OPERATION COUNTER
SIMULTANEOUS OPERATION TIME DATA
TO
52
FIG. 3H
STEP REGISTER
STEP TIME DATA
STn
53
FIG. 3I
TRACK REGISTER
TRACK NO.
TRn
54
FIG. 3J
TRACK COUNTER
TRACK NO.
TR
56
FIG. 3K
TEMPO BEAT REGISTER
TEMPO BEAT DATA
TB
57
FIG. 3L
PLAY TIME COUNTER
TIME COUNT DATA
TM

AUTOMATIC PERFORMANCE SYSTEM

BACKGROUND OF THE INVENTION

1. Field of the Invention

This invention relates to automatic performance system, in particular relates to a one-step automatic performance (play) system (device) wherein automatic performance is performed by one step at each operation of sound generation (canceling), and wherein one generation and one canceling of a musical tone of automatic performance is performed at each sound generating (canceling) operation.

2. Description of Background Art

Although, a one-step automatic performance system is not generally known to the public, the one-step automatic performance system referred to here is basically described as outlined below. A performance data of the one-step performance system consists of plural (multiple) note data, and the note data includes key number data (KN), gate time data (GT), touch data (TC) and so forth. Based on such data, a sound is generated each time a key is operated (or pressed) (key ON). Several "simultaneous commands" are memorized in such performance data, and as each key on the keyboard is pressed, all of the note data existing between a "simultaneous command" and a subsequent "simultaneous command" are generated and are sounded as a sound simultaneously. Accordingly, automatic play progresses sequentially each time a key is pressed. It gives the appearance that the player (performer) is actually playing the same as the automatic performance, instead of merely manually pressing the keys.

In addition to an automatic performance system, there is also a full automatic performance system. This system is already commonly known and operates based on time count. The fully automatic performance system is based on performance information (MP) as shown in FIG. 2. It performs by comparing step time data (ST) for each note data of the performance information (MP) with the time count value, then each note data is generated automatically as a sound in step time sequence as time progresses. The full automatic performance system is generally known to the public.

(1) As said two automatic performance systems are not compatible with each other, a one-step automatic performance system cannot be used together with the fully automatic performance system such as that depicted in FIG. 2 which operates based on time count. However, the purpose of this invention is to enable the one-step automatic play by making use of the performance information from the time-count based automatic performance system.

(2) In addition, there is a drawback in the existing one-step automatic performance system, in that as automatic play advances one-step each time a key is pressed, if the performer leaves the stage or concert area during the middle of a performance, he is apt to forget where he previously left off, and it becomes difficult for him to continue performing when he returns.

(3) There is also another drawback in the existing one-step automatic performance system in that, because some or all of the keys on the keyboard are used for the automatic play operation, the player cannot manually play together (in concert, in soli) along with the automatic performance system, which is a very useful way to practice music if realized.

(4) A further drawback of the one-step automatic performance system as it exists today is that a performance is normally made up of various parts such as melody, background (chords, bass, etc.) rhythm and other performance parts. There are also an upper keyboard, lower keyboard and foot keyboard, pedals, as well as different instrumental group parts, such as keyboard instruments, string instruments, brass instruments, and percussion. In a one-step automatic performance system these parts must be executed simultaneously, and cannot be played separately. Thus, one-step automatic performance still does not allow for changes in musical style, or for extracting or deleting specific parts for one step automatic performance and so forth.

(5) Fully automatic play also has drawbacks in that the respective performance data is played automatically as time progresses. With this system, said gate data (CT) undergoes subtraction processing, or some other form of processing, for example, in order to measure the time duration that the sound remains ON in accordance with the gate time data (GT). Accordingly, the time count speed will accord with the tempo set for automatic performance. In the case of one-step automatic performance, however, as the one-step automatic play progresses each time a key is operated, the tempo for one-step automatic performance does not accord with the time count for the set tempo, as with fully automatic performance, but rather with the speed and interval at which the respective keys are operated. Because of such differences, the following problem arises in relation to systems such as fully automatic performance systems, wherein the measurement of the duration of time that a sound remains ON accords with a set tempo, and one-step automatic performance systems, wherein determination of the timing for generating or canceling a sound accords with the speed and interval at which the keys are operated, particularly when such systems are considered together.

Mainly, for example, if a slow tempo is set and a speed or interval at which the keys are operated is accelerated, and the next key is operated to produce the next sound before the sound currently being played has ended, then the sound which should accord with the previously operated key and the sound which should accord with the key that was subsequently operated become indistinguishable, lowering the overall quality of play.

SUMMARY OF THE INVENTION (1) With this invention, the performance information for generating a musical tone which has a faster timing than all the other information which is to be played, based on the timing data which indicates the timing at which a musical tone is to be generated, is detected and output for play each time a tone is generated.

Also, with this invention, performance information is output each time a sound producing operation is performed. In this manner, based on the timing data used to indicate the timing for the tone which is generated, automatic performance proceeds in conjunction with each sound producing operation, so that one-step automatic performance is realized, including time performance information from time-count fully automatic performance system as is.

(2) In addition with this invention, the amount of time which has elapsed is detected based tone generation, performance operation or a command timing. Following this, the performance information generated by the results of detection of the time which has elapsed is initialized or cancelled (reset), accordingly. Thus, when the performer walks away, etc., during the middle of a performance, the one-step automatic performance operation can be initialized or reset as required, so when the performer returns, he can resume playing smoothly at the point where he left off.

(3) This invention also incorporates two sets of elements for starting or generating sounds. The 1st sound generator is used for generating sound for one-step automatic performance, while the 2nd sound generator is a plural (multiple) generator which also enables sound generation for manual performance. Depending on the sound generation method used, information is assigned to musical tone generating channels, so that musical tones can be played simultaneously as sound is generated. This enables playing together (in concert, in soli), combining one-step automatic performance with manual performance.

(4) In addition, the performance parts or instrumental parts included in the performance information for one-step automatic performance can be selected separately, thus can be changed (toggled) for both for sounding and playing. This enables the parts to be played by one-step automatic performance to be selected based on the respective parts, and also enables extraction or deletion of specific parts.

(5) In addition with this invention, based on continuous time information for the generated performance information, performance information, which should cancel the sound before the next performance information is generated, in accordance with the sound producing operation or the play command executed by the sound producing method being used, is determined, and execution of the respective performance information which was initiated by said sound producing operation is canceled. In this way, not only tone generation, but also cancellation of a tone can be executed at a tempo set based on tone generation or a performance command used to play a one-step automatic performance. This means that a musical tone can be distinguished from the next musical tone without being connected together, thus enabling a higher quality of play. Particularly, as the timing for generation of one musical tone and the timing generating another musical tone are not interchanged or intermixed, the timing for generating and canceling tones can be synchronized and executed on the same time scale.

Automatic play progresses automatically with each sound generating operation based on timing data that indicates the timing for sounding a tone. In this manner, performance information for time count automatic play can be used with one-step automatic play. Also, as automatic play is made to progress one step each time a sound is generated, if a subsequent tone generating operation is not performed within a fixed interval after a tone has been generated, one-step automatic play is initialized or reset, preventing confusion and enabling smooth resumption of a performance In Instances after it is interrupted. In addition, the information based on the tone generation operation for one-step automatic play and the information based on the sound generating operation for manual play are assigned to tone generating channels, which enables one-step automatic play and manual play to be performed together (in concert, in soli). Also, whether or not one-step automatic play is performed can be selected for each respective performance part or instrumental part. In addition, while said one-step automatic play is in progress, performance information which should be canceled before the next performance information is generated by sound generation (performance command) can be determined and canceled. This permits not only tone generation, but also tone cancellation in accordance with the tempo set based on sound generation (performance command) for one-step automatic play.

BRIEF DESCRIPTION OF THE DRAWINGS

FIGS. 3A to 3L are diagrams showing the working memory 32 for the RAM 6.

DETAILED DESCRIPTION OF THE PREFERRED EMBODIMENTS

Figure 7:
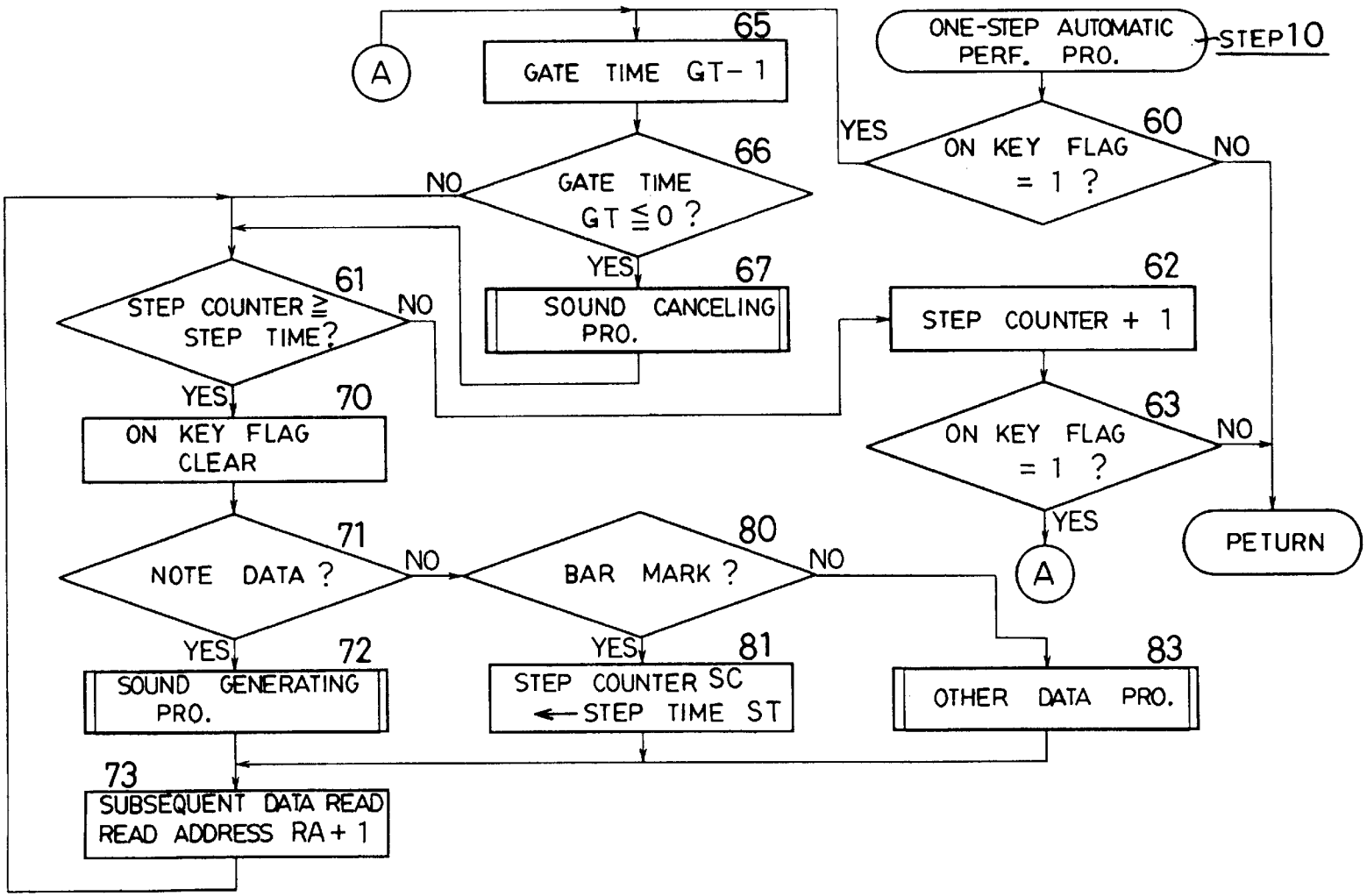
FIG. 7 is a flow chart for one-step automatic performance processing (step 10).

Summary of the Embodiments (1) At each key ON (step 40), an ON key flag is set (step 46), step count data SC increments at high speed (steps 61 to 63), note data for identical step time data ST is generated (steps 71 and 72), then the ON key flag is cleared (step 70) and automatic play sets to standby for the next key ON operation. Then an automatic performance is executed by one step at each key ON (FIG. 7).

(2) Each time key ON is performed for one-step automatic play, the initialization/cancel (initialization/reset) time data IC is stored in time counter 49 (step 43). This initialization/cancel time data IC is decremented by "1" at a fixed interval by interrupt processing (step 92). When the data IC becomes "0", the read address data for the performance information MP is cleared and the program being played by one-step automatic play is initialized or reset from the beginning (step 96). Also, the one-step flag for mode flag register 41 is cleared, canceling one-step automatic play (see FIG. 13).

(3) Performance information MP is memorized in each track by play part. For each play part, either fully automatic play, one-step automatic play or manual play (steps 20 and 21) is selected. During one-step automatic play processing (FIG. 7) and fully automatic play processing (FIG. 10), said play mode for each play part is checked (steps 102 and 140 in FIG. 8); the performance information MP in the tracks for the pertinent mode is read out for sound/play, and performance information MP (tracks) for other modes is muted. Play parts for the manual mode are sounded or played manually (step 48).

(4) Performance information MP is memorized in each track depending on the respective play part. Whether or not one-step automatic play can be performed is selected depending on the specific play part (steps 20, 21). During one-step automatic play (FIGS. 7 to 9), whether or not one-step automatic play can be performed is checked for each play part (steps 64 and 102), and only performance information MP in the tracks for the pertinent mode is read out for sound/play.

(5) Gate time data GT decrements (steps 65 and 66) after each key ON operation (step 40). At the same time, step count data SC increments at high speeds (steps 61 to 63); sound for the note data for gate time data GT which becomes "0" is canceled (step 67), and note data for the identical step time data ST is generated (steps 71 and 72) as shown in FIG. 7. Accordingly, this enables all of the musical tones which have been previously generated but should be canceled to be detected and canceled (step 67) before the next performance information is generated by key ON operation for keyboard 1 (step 72). This prevents the sound generation timing for musical tones currently being generated from being interchanged with the sound canceling timing for other tones, allowing the step time and gate time to be executed at the same time scale.

1. Overall circuitry

Figure 1:
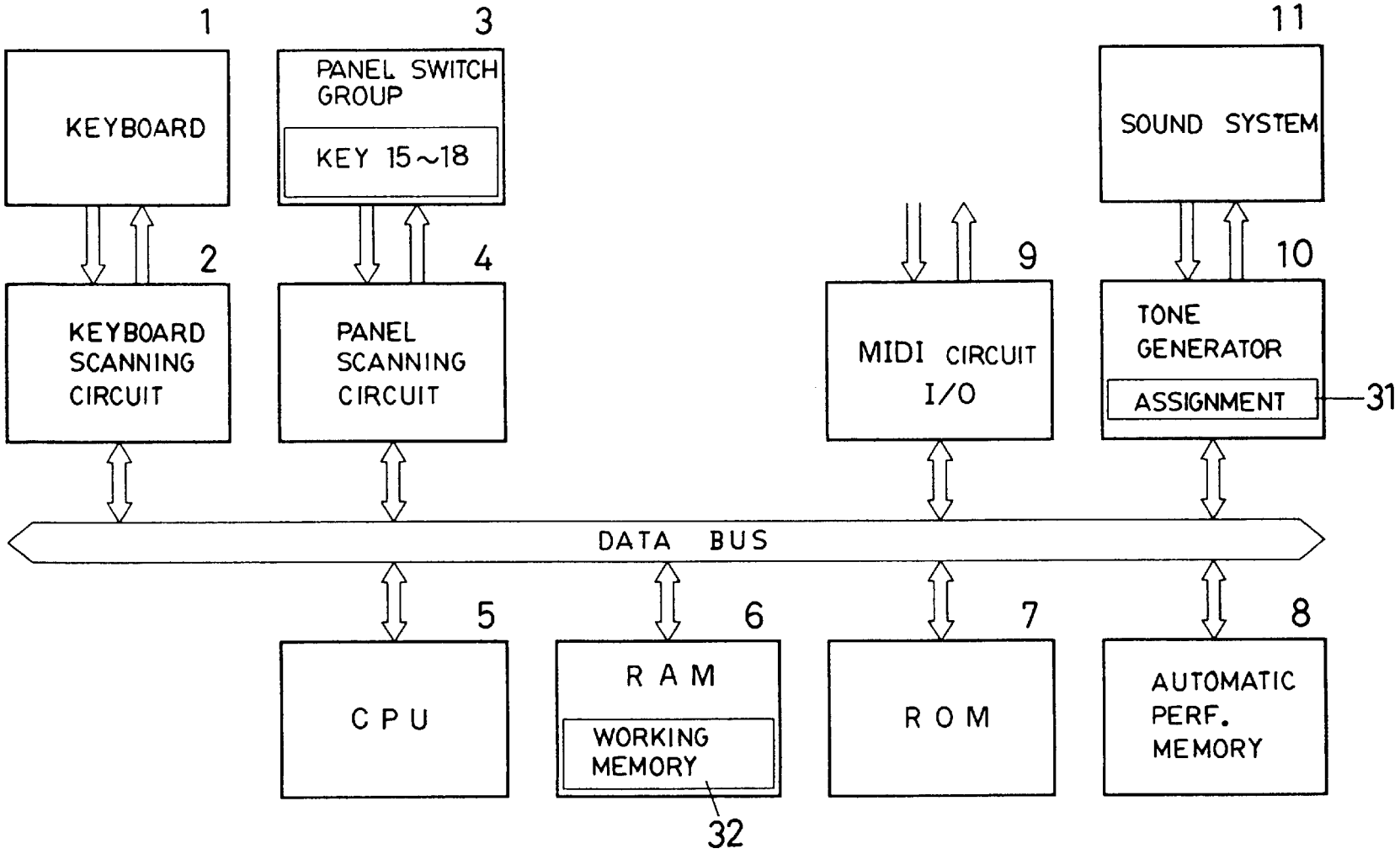
FIG. 1 is a diagram of the overall circuitry of an electronic musical instrument.

FIG. 1 is a diagram of the overall circuitry for an electronic musical instrument. The operations for generating and canceling sounds are performed using the respective keys on keyboard 1. Each key on keyboard 1 is scanned by key scanning circuit 2. Accordingly, data which indicates the key operation (key ON/key OFF) is detected. Following this, CPU 5 writes this data in RAM 6, then compares it with the data used for indicating the key ON and OFF state for each key previously memorized in RAM 6. CPU 5 then determines whether an ON event or OFF event is selected for each key.

In said manner, the key position for ON/OFF is detected, and as said key scanning is performed periodically, the key ON/OFF timing is also detected. Note that electronic strings, electronic brass instruments (leads), electronic percussion (pads), a computer keyboard and so-forth can be substituted for said keyboard 1. One-step automatic play is performed using all the keys on keyboard 1 or a specific group of keys or specific keys on keyboard 1. In the case of one-step automatic play, each time a key is operated (a key is pressed or released), automatic performance progresses one step at a time; more precisely a sound is generated and canceled for each individual tone.

Switches in panel switch group 3, which will be described later, are scanned by panel scanning circuit 4. By means of scanning, data indicating ON/OFF for each switch is detected and CPU 5 writes this data in RAM 6, wherein it is compared with data previously memorized in RAM 6. Following this, CPU 5 determines whether an ON event or OFF event is selected for each key.

Data for said key ON/key OFF, said ON event/OFF event and data for ON event/OFF event for each switch is generated and received from other processing devices (electronic musical instruments) via MIDI (musical instrument digital interface) circuit 9, and is also generated and sent to other processing devices (electronic instruments).

Panel switch group 3 is equipped with mode selector key 15, part set key 16, program selector key 17, tone key 18 and other keys. With mode selector key 15, modes can be toggled among the fully automatic mode, all-key one-step mode, the partial one-step mode and the manual mode etc.

In the fully automatic play mode, normally fully automatic play is performed, regardless of whether keys are operated or not. In the all-key one-step mode, one-step automatic play can be performed by using all the keys on keyboard 1. With this one-step automatic play, automatic play progresses one sound (step) each time a key is operated. In the partial one-step mode, automatic play can be performed using a specific group of keys on keyboard 1, while manual play can be performed using another key group. This allows the performer to perform together (in concert, in soli), combining automatic play and manual play.

If said partial keys correspond to the upper keyboard, lower keyboard, foot keyboard, pedals or rhythm keys, etc., for example, then the keys on said keyboard 1 can be divided accordingly for the respective keyboards and key groups. In the manual mode, all the keys on keyboard 1 can be used for manual plays Using said part key 16, the mode for each part can be changed or selected from among the fully automatic mode, the all key one-step automatic mode, the partial one-step automatic mode and the manual mode. The play parts, for example, include melody, background (chords, bass, backing, arpeggio, etc.), rhythm, etc. Changing or selection of play parts is performed indirectly using the upper keyboard, lower keyboard, foot keyboard, pedals, rhythm key, etc.

Note that this mode selection (changing) and play part selection (changing) also can be performed using methods other than said method or simply using one key (for example, operating one key only to toggle between modes 1, 2 and 3). In mode 1, rhythm or background is played by fully automatic model while background or melody is played by one-step automatic play using all the keys on-keyboard 1. In mode 2, rhythm is played by fully automatic play and background is played by one-step automatic play using the lower keyboard, while melody is played by manual performance using the upper keyboard. In mode 3, manual play can be performed using all the keys on keyboard 1.

Panel switch group 3 is not illustrated; however, this key group consists of the fully automatic start key, rhythm type keys and so forth. Said fully automatic play is begun by the fully automatic start key. Rhythm type keys are used to select the type of rhythm for fully automatic play. Available rhythm types are waltz, disco, march, rock and 16 beat, etc.

Program selector key 17 is used to select a musical selection in the performance information MP for one-step automatic play. Tone key 18 is used for selecting the musical tone for performance by said keyboard 1. Tone key 18 can set/change a tone (tone number data TN) for the performance information MP.

In addition to the various types of said data, various other types of data processed by CPU 5 and various data required for processing are memorized in RAM 6. Working memory 32, which is described later, is also incorporated in RAM 6. Also, as depicted in the attached flow charts described later, programs which are executed by CPU 5 and programs which relate to other processing are memorized in RAM 6. These programs, which are originally stored media such as floppy disks, CD-ROM/RAM, RAM/ROM cards, etc., are loaded into RAM 6 from the respective media. The respective programs can also be memorized in ROM 7.

Performance information MP for a plural (multiple) number of selections is memorized in automatic play memory 8. This performance information MP is read out and is generated by CPU 5 and played by one-step automatic play. Automatic play memory 8 is configured of a RAM or ROM and can be combined with RAM 6 or ROM 7, or can be a RAM/ROM card, floppy disk or CD-RAM/ROM. Performance information MP, key ON/OFF events, note data, etc., are generated and transmitted/received by other processing devices (electronic instruments) via the MIDI circuit 9, and may be generated or transmitted to other processing devices (electronic instruments).

Tone data according the performance information MP and tone data depending on the ON/OFF setting for the keys on keyboard 1 are sent to tone generator 10, while sound is generated by sound system 11. Tone generator 10 incorporates a tone generation system for plural (multiple) channels, whereby, for example, 16 channels are formed by time division processing and tones are generated polyphonically. Tone generator 10 is also equipped with assignment memory 31.

Said assignment memory 31 has a memory area capacity for 16 channels and when said tone generation begins, either performance information containing musical tones which are assigned to said channels or operation/command information is written into assignment memory 31, then the respective tones are simultaneously sounded by tone generator 10 according to this information. Said information includes ON/OFF data, key number data KN, tone number data TN, touch data TC, gate time data GT, etc.

ON/OFF data indicates the ON/sound generation setting ("1") and OFF/sound cancellation setting ("0") for each key on keyboard 1 or the tone in each performance information MP for automatic play. When ON/OFF data set for "1"is overwritten by "0", the tone is switched from the sound generating state to the sound canceling state. When the tone is switched from the sound generating state to the sound canceling state, the envelope waveform enters the release state, wherein the tone is attenuated but is not canceled immediately. When the tone is switched from the sound canceling state to the sound generating state, the envelope waveform enters the attack state, then switches to the decay, sustain and release states. Other data (KN, TN, TC, GT) will be described in the following sections (gate time data GT can be omitted).

2. Performance information MP

Figure 2:
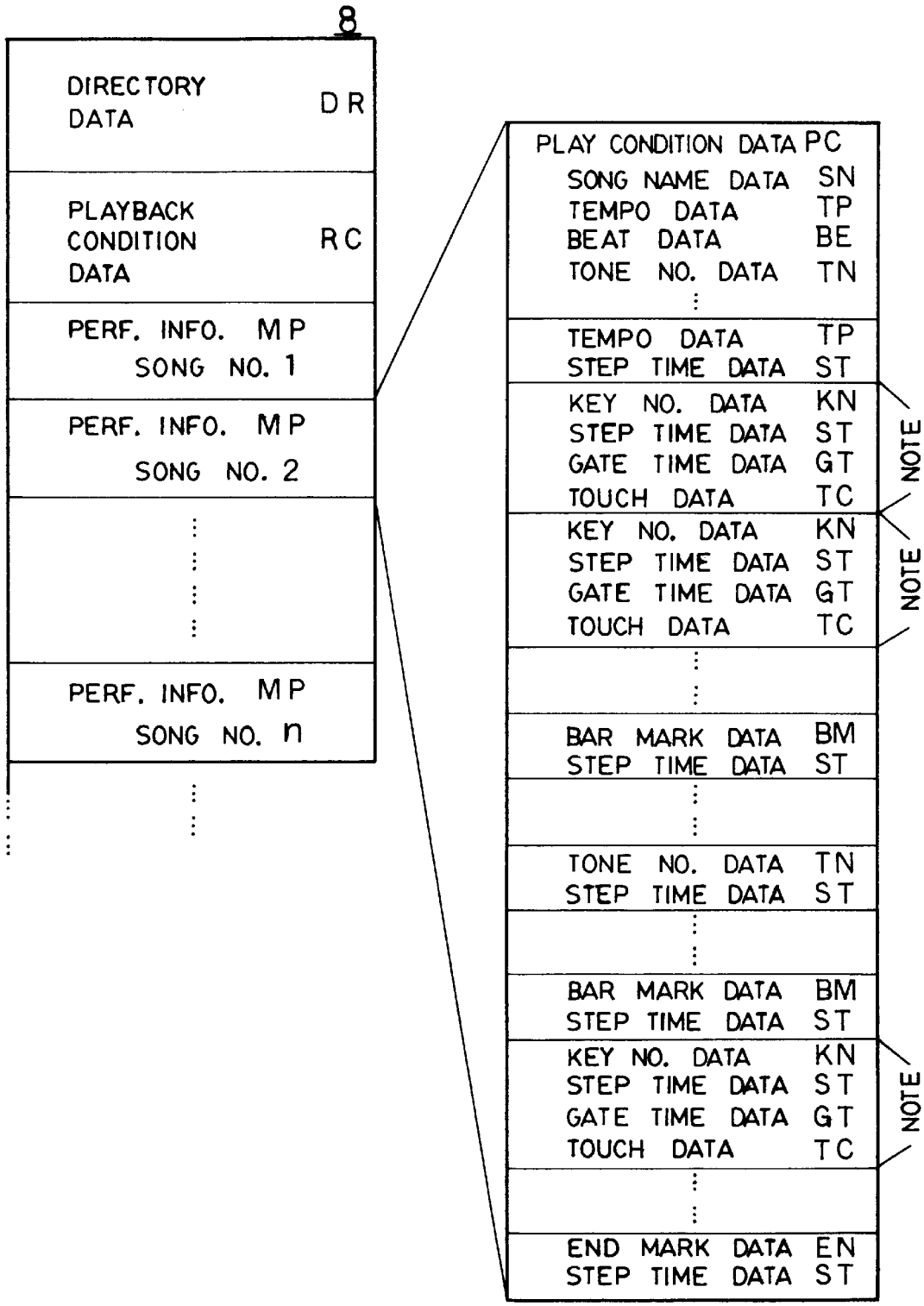
FIG. 2 is a diagram showing the performance information MP for the automatic performance memory 8.

FIG. 2 illustrates the content of data memorized in said automatic play memory 8. In automatic play memory 8, data memorized in directory data DR and playback condition data RC is memorized at the top of the memory area in automatic play memory 8, then performance information MP for plural (multiple) selections is memorized following said data DR and RC. The performance information MP is data for melody parts; however, other parts such as chords, bass, backing, arpeggio, rhythm, etc., are also memorized.

The performance information MP consists of note data groups along with bar mark data BM, and end mark data EM, etc., which are inserted between said note data groups. The note data consists of key number data KN (tone pitch), step time data ST, gate time data GT, touch (velocity) data TC, etc.

Key number data KN indicates the numbers for each key on keyboard 1, or the position of each key and tone pitch. Cent data CT can also be included in key number data KN. Step time data ST indicates the duration of time from the beginning of each music (song) or a bar (from the bar mark data BM) until either a tone is generated according to note data, or until a command is executed. This command is for tone changes, tempo changes, key changes, etc. Gate time data GT indicates the continuous sound generation from key ON until key OFF.

Touch (velocity) data TC indicates key ON/OFF timing speed or strength. Touch data TC corresponds with the time gap between ON/OFF timing for plural (multiple) key switches. These plural (multiple) key switches are incorporated in each key on keyboard 1 and turned ON/OFF at a different timing when the keys are operated. The volume for tones, frequency components, etc., is controlled according to touch data TC. Said bar mark data BM indicates the separation between each bar. End mark data EM indicates the end of each music.

At the beginning of the performance information MP, performance condition data PC is stored (memorized). This performance condition data PC comprises song name data SN, tempo data TP, beat data BE, tone number data TN, etc. Tempo data TP and beat data BE indicate the tempo and rhythm for automatic play using this performance information MP.

Said tone number data TN indicates the tone color for instruments, such as pianos, violins, flutes, drums, etc. The tone number data TN indicates each read address data for start, loop top and loop end of tone waveform for data reading, envelope waveform data, data corresponding to the formant form, frequency spectrum components, high-harmonic waves components, touch data TC and key scaling data. Note that tone number data TN, tempo data TP and key change data are memorized in the middle of the performance information MP for one music, while tone, tempo and key can also be changed in the middle of the music.

Said performance information MP for one music is memorized on plural (multiple) tracks by said play parts. The performance information MP in FIG. 2 is for a melody part. For background part (chords, etc.), note data consists of chord data CD and step time data ST. Chord data CD indicates the type and route for a chord. For the rhythm part, note data consists of touch data TC, or tone data TN, and step time data ST. Tone number data TN refers to rhythm instruments, such as bass drums, snare drums, high hat, cymbals, bongos, etc.; note, however, that said performance parts include instrument parts (keyboards of upper/lower/foot etc., pedals, strings, brass and percussion). Also, tone number data TN can be memorized at the top of each track and tones can differ for each track.

In addition, the performance information MP for the rhythm part is memorized for each rhythm type in automatic play memory 8, independently of melody and background parts; and the rhythm selected by said rhythm type key can also be played by fully automatic play. In addition, the performance information MP for melody, background and rhythm parts can also be memorized together as one, without being divided into plural (multiple) tracks. However, in such instances, each note data includes part data and part data indicates the melody, background or rhythm etc. Furthermore, part data can be omitted. In such cases, if key number data KN is higher than the specific tone (high-pitched tone range), this note belongs to the melody part, and if the key number data KN is lower than the specific tone (low-pitched tone range), this note belongs to the background part. In addition, the parts can be determined depending on whether the note data contains chord data CD or key number data KN.

3. Working memory 32

FIGS. 3A to 3L illustrate working memory 32 for RAM 6. Working memory 32 consists of the various registers, buffers, counters and memories depicted in FIG. 3.

Mode flag register 41 stores (memorizes) flag data which indicates the operation of electronic musical instruments. These flags are the parts mode flag, ON key flag, bar standby mode flag, etc. The parts mode flag indicates the performance mode for each performance parts or instrument parts. The performance parts are melody, background (chords, bass) and rhythm parts and the instrumental parts are upper keyboard, lower keyboard, foot keyboard, pedals and rhythm key groups.

As for performance modes, said fully automatic performance (fully automatic mode), one-step performance (all-key one-stop mode/partial key one-step mode) and manual performance (manual mode) are supported. If the parts mode flag is 8-bit data, for example, the upper 4 bits are full-auto bits which indicate ON/OFF for fully automatic play for the 4 respective performance parts, while the lower 4 bits are one-step bits which indicate ON/OFF for one-step performance for the 4 respective performance parts.

If both the fully automatic bit and one-step bit for each part are set for "0", the pertinent part is set for said manual mode; if the lower 4 bits are set to "1111", the mode is said all-key one-step mode. If any one of the bits is "1" and any one of the bits is "0", the mode is the partial one-step mode. Determination of the mode is performed by AND or OR of the respective bits. The styles used by the parts mode flag can be other than those described above.

The ON key flag indicates key ON for keyboard 1 in the one-step automatic performance (play) mode. The bar standby mode flag indicates that when the bar mark data BM is read during fully automatic performance (play), processing is set to standby up until the current bar separation.

Playback register 43 stores tone data (key number data KN, step time data ST, gate time data GT, touch data TC, chord data KD, tone number data TN, etc.), according to the performance information MP. In playback register 43, plural (multiple) tone data can be stored in each track. In tone number register 45, tone number data TN which is input by tone color key 18 of panel switch group 3 or tone number data TN in the performance information MP is stored for each track. Note that playback register 43 also can be omitted and the performance information MP which is read also can be sent directly to assignment memory 31. Gate time data GT stored in playback register 43 is decremented sequentially by one-step automatic performance (play) processing and when it becomes "0", the tone is canceled. During this sound canceling processing, the ON/OFF data in assignment memory 31 is rewritten from "1" to "0".

Step counter 47 is incremented by "1" by CPU 5 to count the step count data SC during one-step automatic play or fully automatic play processing described later.

This step count data SC is compared with step data ST in the note data to determine the sound generation start timing. Step counter 47 consists of two counters: one for one-step automatic play processing and the other for fully automatic play processing. At the sound generation start timing, the ON/OFF data in assignment memory 31 is rewritten from "0" to "1".

Read address counter 48 memorizes read address data RA for the performance data MP in each track of automatic play memory 8, then this address data RA is incremented each time the performance data MP is read out.

Reset time counter 49 stores the initialization/cancel (initialization/reset) time data IC for a specified value each time a key in the one step area on keyboard 1 is set to ON and is decremented at a fixed interval until it reaches "0". When the time data IC reaches "0", read address data RA for the performance data MP in read address counter 48 is cleared/reset to "0" and the one step flag for mode flag register 41 is cleared. If the time for initialization/cancel time data IC has elapsed after the key is set to ON during one-step automatic play, either the music being played by one-step automatic play is reset (initialized) to the beginning of the music or one-step automatic play is canceled.

Simultaneous operation counter 51 stores simultaneous operation time data TO when a key is set to ON and the time data TO decrements at a fixed time interval until it reaches "0". For the duration of time until time data TO decrements to "0", one-step automatic play according to a subsequent key operation is prohibited. Also, according to this, even if a plural (multiple) number of keys are pressed simultaneously, as is the case for manual play, the one-step automatic play will not progress too far, to give the external appearance that the performer is still playing well.

Step register 52 stores the smallest step time data ST from among those of performance information MP in each track to be read (generated) next. In some cases, plural (multiple) number of smallest step time data ST may exist, and next the tones of plural (multiple) tracks will be generated simultaneously. Track register 53 stores the track number belonging to the note data to be generated next. Track counter 54 is used for searching (scanning) and detecting the smallest step time data ST from the respective tracks.

Tempo beat register 56 stores the tempo beat data TB according to tempo data TP and beat data BE in the performance information MP. This tempo beat data TB indicates the time for one bar. Performance time counter 57 is incremented by "1" by CPU 5 each time clock signal $\phi$3 sets at HIGH level, and time count data TM is counted. When time count data TM matches up with tempo beat data TB, time count data TM is cleared. Each time clock signal $\phi$3 sets at HIGH level, a fully automatic cycle interrupt processing, described in a latter section, is performed.

4. Main routine

Figure 4:
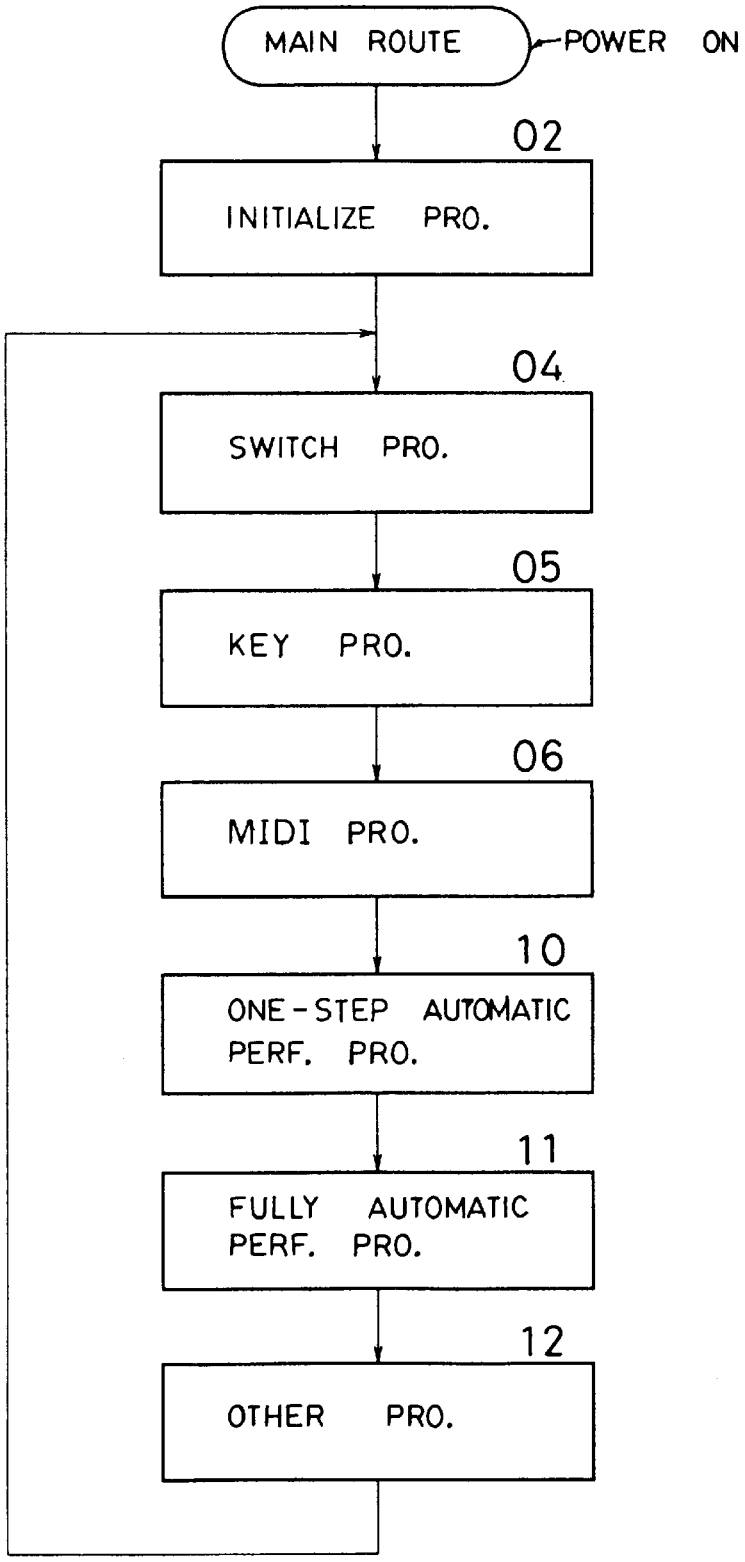
FIG. 4 is a flow chart of the main routine.

FIG. 4 is a flow chart for the main routine which is executed by CPU 5. This processing is started by turning the power ON. First, RAM 6, working memory 32, etc., are cleared and various initialization processing is performed (step 02). Next, ON/OFF or ON/OFF events for keys 15 to 18, etc., in panel switch group 3 are detected, and processing is performed according to the operation of the key for which the ON/OFF or ON/OFF events are detected (step 04). Then, ON/OFF or ON/OFF events for each key on keyboard 1 are detected and sound ON/OFF processing is performed according to the operation of the key for which the ON/OFF or ON/OFF event is detected (step 05).

Next, if data/information for example the ON/OFF events for keyboard 1, note data, operation events for keys 15 or others to 18, which are generated and received from another instrument exist in MIDI circuit 9, this data/information is sent to RAM 6 etc., tone generator 10, etc., to generate/cancel sound (step 06). Also, if the data/information for example the ON/OFF events for keyboard 1, note data, operation events for keys 15 to 18 or others, which are generated and sent from another instrument exist in RAM 6 etc., this data/information is sent to MIDI circuit 9 and sound is generated/canceled by the other instrument (step 06). Also, data transfer to MIDI circuit 9 can be executed periodically by the interrupt processing at a fixed time interval.

As a result one-step automatic play is performed according to said performance information (step 10). In addition fully automatic play according to said performance information MP is performed (step 11).

Details of this processing will be described in a latter section. Following this, other additional processing is also performed (step 12). The processing in steps 04 to 12 is repeated until the power is turned OFF.

5. Switch processing

Figure 5:
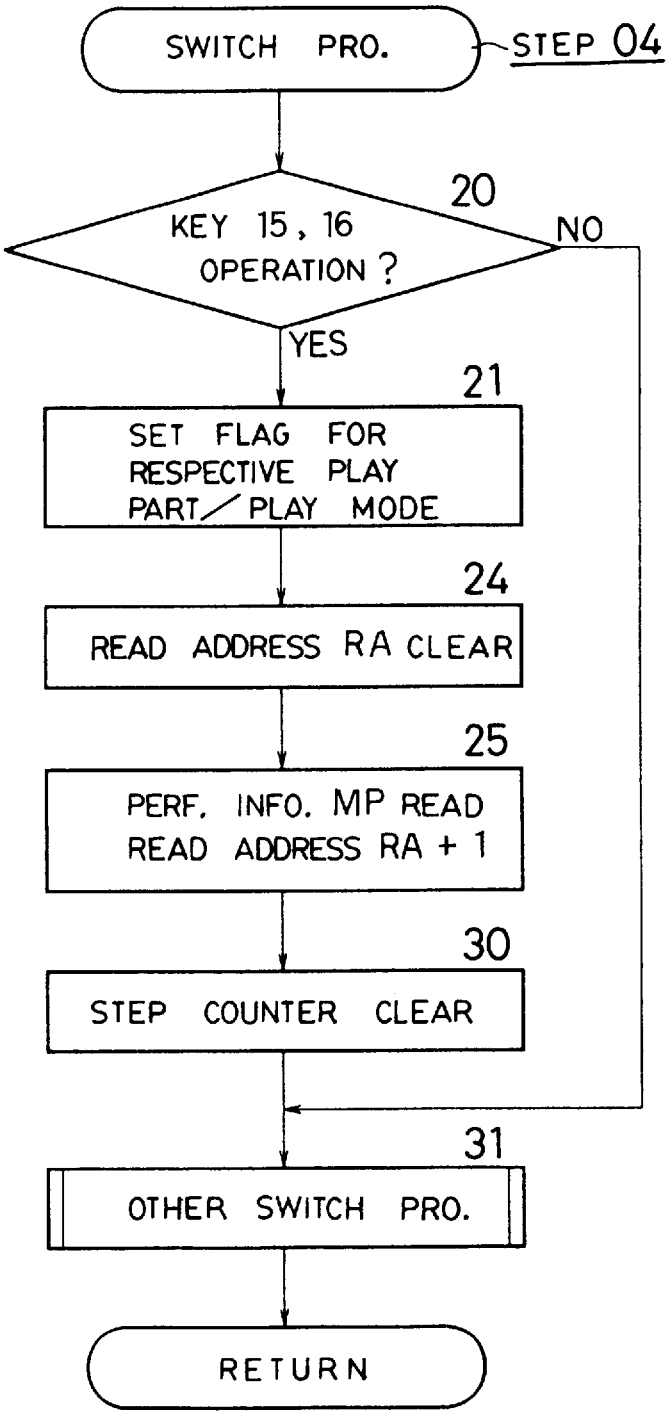
FIG. 5 is a flow chart for switch processing (step 04).

FIG. 5 is a flow chart for the switch processing for step 04. When the performance mode for each performance (play) part is input by mode selector key 15 and part set key 16 (step 20), the appropriate parts mode flag is stored in mode flag register 41 (step 21). If the one step flag for one-step automatic play is set for "0", for example, the parts mode flag is set for "1", and if the one step flag is set for "1", the mode flag is set for "0".

Following this, the read address data RA in each track for read address counter 48 is cleared (step 24). Next, one or more of plural (multiple) note data, etc., is read out from the top (start) of the performance information MP for a music (musical selection), which was chosen by music musical selection key 17 or by a rhythm key, and then is stored in playback register 43, then, read address data RA increments by "1" (step 25) and step counter 47 is cleared (step 30).

Following the above, other switch processing is performed (step 31) and a routine is returned. During the other switch processing, musical selection processing, corresponding to the operation of musical selection key 17, and tone set/change (switch) processing, corresponding to the operation of tone key 18 is performed. Note that during mode setting in steps 20 and 21 above, modes 1, 2 and 3 can also be switched sequentially and selected by a ring operation.

6. Key processing (step 05)

Figure 6:
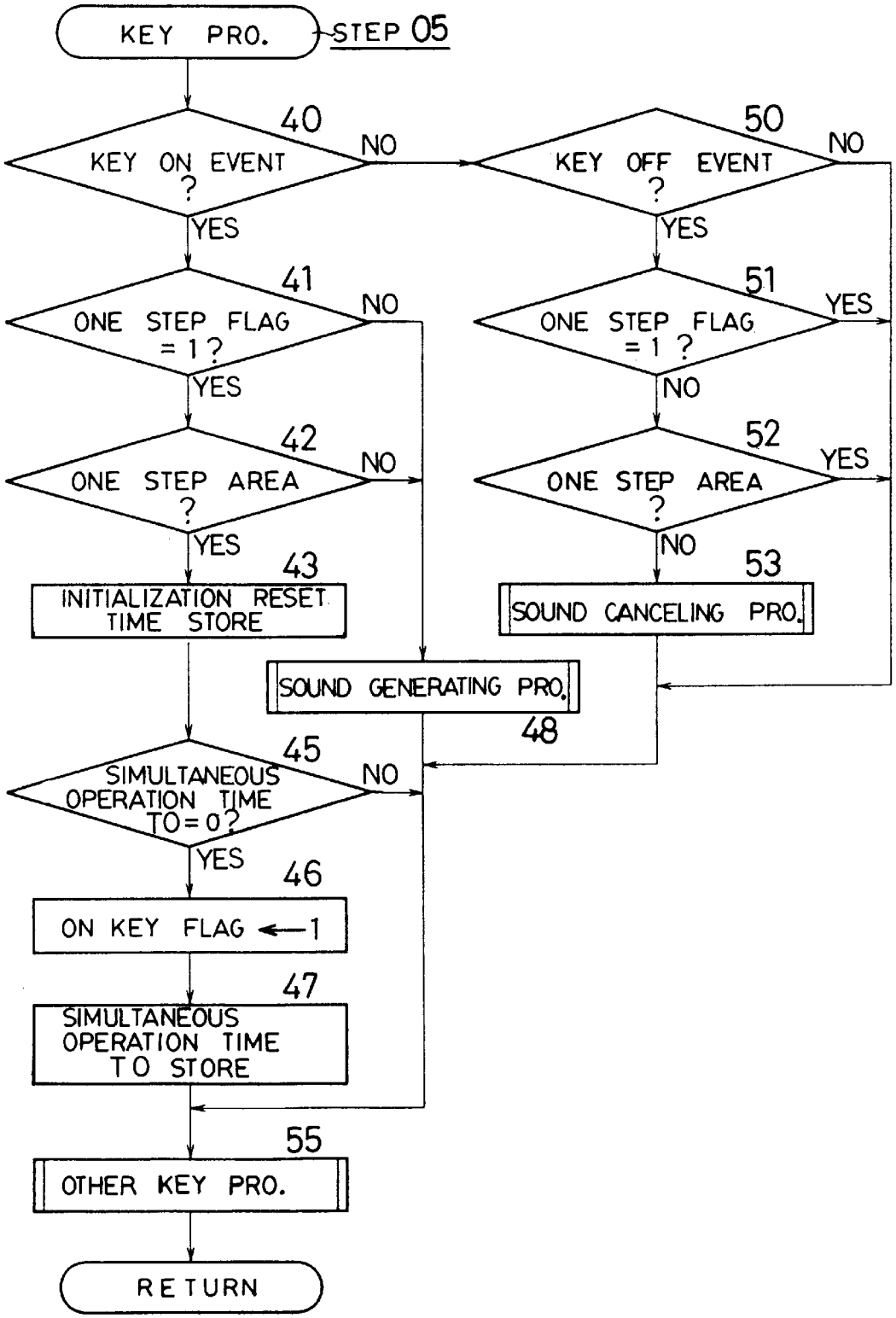
FIG. 6 is a flow chart for key processing (step 05).

FIG. 6 is a flow chart for the key processing in the step 05. First, when a key ON event for keyboard 1 is detected (step 40), it is determined if all-key/partial key one-step mode is set (step 41). If the key set to ON is contained in the one-step area (step 42), the initialization/reset time data IC is stored in reset time counter 49 (step 43). And, if the simultaneous operation time data TO for simultaneous operation counter 51 in working memory 32 is set for "0" (step 45), the ON key flag for mode flag register 41 is set for "1" (step 46) and the simultaneous operation time data TO is stored again in simultaneous operation counter 51 (step 47).

If simultaneous time data TO does not reach "0" (step 45), the ON key flag will not be set for "1" even if the key is set to ON, consequently the one-step automatic play (described later) is not performed. This allows the performer to act as if he were playing manually even during one-step automatic play by pressing keys on the keyboard simultaneously.

If the all-key/partial key one-step mode is canceled and said ON key is not contained in the one-step area (steps 41 and 42), the sound generating processing for normal manual play by pressing the keys to ON is performed and the data according to key ON is output via MIDI circuit 9 (step 48).

Also, when a key OFF event for keyboard 1 is detected (step 50), the all-key/partial key one-step mode is canceled, and if the key set to OFF is not contained in the one-step area (steps 51 and 52), the sound canceling processing according to key OFF is performed (step 53). Then other key processing is performed (step 55) and a routine is returned.

Said one-step area is a key area for one-step automatic play and includes the upper keyboard, lower Keyboard, foot keyboard, pedals, rhythm key group, lowest tone, highest tone, mid tone, lowest 1-octave and highest 1-octave, mid 1-octave, etc. Detection for the one-step area is performed as follows: Which section (from among the upper keyboard, lower keyboard, pedals, foot keyboard, rhythm key group) that the key which is pressed to set to ON (key ON) belongs to is detected. If the one-step bits for the performance part corresponding to said detected keyboard or key group are set for "1", the key pressed to set to ON belongs to the one-step area, however, if these bits are not set to "1" said key does not belong to the one-step area. The one-step bits are the lower 4 bits of the parts mode flag for mode flag register 41 described above.

Note if all the keys for keyboard 1 or all the keys in the one-step area, are set to OFF (key OFF), all the tones being generated by one-step automatic play can be also canceled. In this instance, if the key set to OFF belongs to the one-step area in the step 52, whether or not all the keys on keyboard 1 or all the keys in the one-step area are set to OFF (set for "0"), or whether or not any one of the keys is set to ON (set for "1") is determined based on the ON/OFF data in RAM 6. If all the keys are set to OFF, the ON/OFF data for all the data in assignment memory 31 is overwritten with "0", and all the tones being generated are canceled simultaneously.

In this instance, all the tones being generated by one-step automatic play can also be canceled after a specified time has elapsed after all the keys on keyboard 1 or the keys in the one-step area are set to OFF. If a key which is set to OFF belongs to the one-step area in above step 52, all the tone OFF data is stored in working memory 32, and the subsequent processing is performed by operation cycle interrupt processing outlined in FIG. 11, by simultaneous operation cycle interrupt processing outlined in FIG. 12, or by initialization/reset cycle interrupt processing or exclusive interrupt processing outlined in FIG. 13. More precisely, if the one step flag is set for "1", all tone OFF data decrements by "1" until it reaches "0"; and when it reaches "0", the ON/OFF data for all the data in assignment memory 31 is overwritten with "0", and all the tones being generated are canceled.

Also, if the keys in the one-step area and keys in other areas are operated simultaneously, one-step automatic play can be performed together (in concert, in soli) with manual play. One-step automatic play also can be performed using all the keys on keyboard 1. Then the steps 42 and 52 can be omitted for this type of performance.

7. One-step automatic performance (play) (step 10)

FIG. 7 is a flow chart of the one-step automatic play processing in above step 10. First, if the ON key flag is set for "1" (step 60), gate time data GT in each note data stored in playback register 43 decrements by "1" until it reaches "1" (steps 61 to 63 and 65). If one or more of gate time data GT reaches "0" (step 66), the corresponding tones will be canceled (step 67). By this tone cancellation processing, the corresponding ON/OFF data for the data in assignment memory 31 is overwritten from "1" to "0" and the corresponding tones are released.

At this point, step count data SC in step counter 47 increments to a value equivalent to or exceeding each step time-data ST in playback register 43 (step 61, 62 and 63). If the data SC is equal the data ST (step 61), the ON key flag is cleared to "0" (step 70), and if the equaled step time data ST relates to the note data (step 71), this note data is sent to tone generator 10 along with tone number data TN etc. and generated, then output via the MIDI circuit 9 (step 72).

As described above, tones that are currently being generated but which should be canceled before sound starting by key ON at the keyboard 1 (step 72) are detected and then canceled (step 67). Note, however, that the tones which are being generated but should not be canceled are continuously generated. In this instance, the value set for the gate time data GT for tones which should not be canceled is high, and even if step count data SC matches up with step time data ST, gate time data GT does not decrement to "0".

Accordingly, even if a long tone which sounding time is long overlaps with a short tone which sounding time is short, the one-step automatic performance never becomes bad (poor). Also, this prevents the sound generating timing of a tone from being interchanged with the sound canceling timing for other tones, and both the sound generating timing and sound canceling timing are executed sequentially in the order of performance, based on the same and one time scale, so that there is no time lag during the performance.

Also, the note data in playback register 43 is cleared and deleted and the subsequent note data (one or more) etc. are read out and stored in the playback register 43, then the read address data RA in the pertinent track increments by "1" (step 73). Following this, if step count data SC is larger than the value of step time data ST for the note data, this note data is generated and output (steps 70 to 72). As above, note data which has the same or almost the same step time ST is generated simultaneously by time division.

Next, if step data ST which exceeds the value of step count data SC can no longer be detected (steps 73 and 61), step count data SC increments (step 62) and the key set to ON (ON key flag) is cleared in the step 70 so that a routine can be returned. Note that in some cases note data, etc., may be sent to MIDI circuit 9 by the sound generating processing in above step 72.

Also, in above steps 25 and 73, the subsequent note data, etc., are read out. In this instance, note data which has step data ST that is equal to step data ST of the read note data can be read out simultaneously and stored in playback register 43. In this instance, only multiple note data having the same value as step data ST is stored in playback register 43. In addition, in above step 61, step time data ST for multiple note data can be compared with step count data SC.

As stated above, automatic play is performed when a key on keyboard 1 is set to ON. Accordingly, if an additional key is not set to ON, the key ON flag is not set (steps 40 to 46), and automatic play sets to standby (step 60) until the next key ON operation is performed. Step count data SC increments at high speeds at each key ON operation and note data with equivalent step time data ST is generated, then automatic play sets to standby until the next key is set to ON. In this manner, automatic play is made to progress one step each time a sound is generated using performance information MP containing step time data ST, while one tone is generated and canceled with each operation.

If the equivalent step time data ST to the data SC is bar mark data BM (step 80), the value of step count data SC for step counter 47 is assumed as the value for step time data ST for this bar mark data BM (step 81), and bar mark data BM in playback register 43 is cleared and deleted, then the next note data, etc., are stored in playback register 43 (step 73). In this manner, one-step automatic play advances to the beginning of a subsequent bar.

If the equivalent step time data ST to the data SC is another tone number data TN (step 80), this data is stored in working memory 32 (step 83) and the tone, tempo, beat, etc. are altered. Note that if each step data ST in the performance information to be played by one-step automatic play is the data indicating the time from the beginning of each bar (the bar mark data BM), then the step count data SC in step counter 47 is cleared in step 81.

Also, clearing of the ON key flag in above step 70 can also be performed following the sound generating processing in step 72. In this manner, not only the bar mark BM, tone number data TN, etc., are executed, but also the next note data is executed simultaneously and generated. Also, in steps 25, 73, 72, etc., the performance information MP in automatic play memory 8 specified by the read address data RA is directly read out, so playback register 43 can be omitted.

8. Data reading processing (steps 25 and 73)

Figure 8:
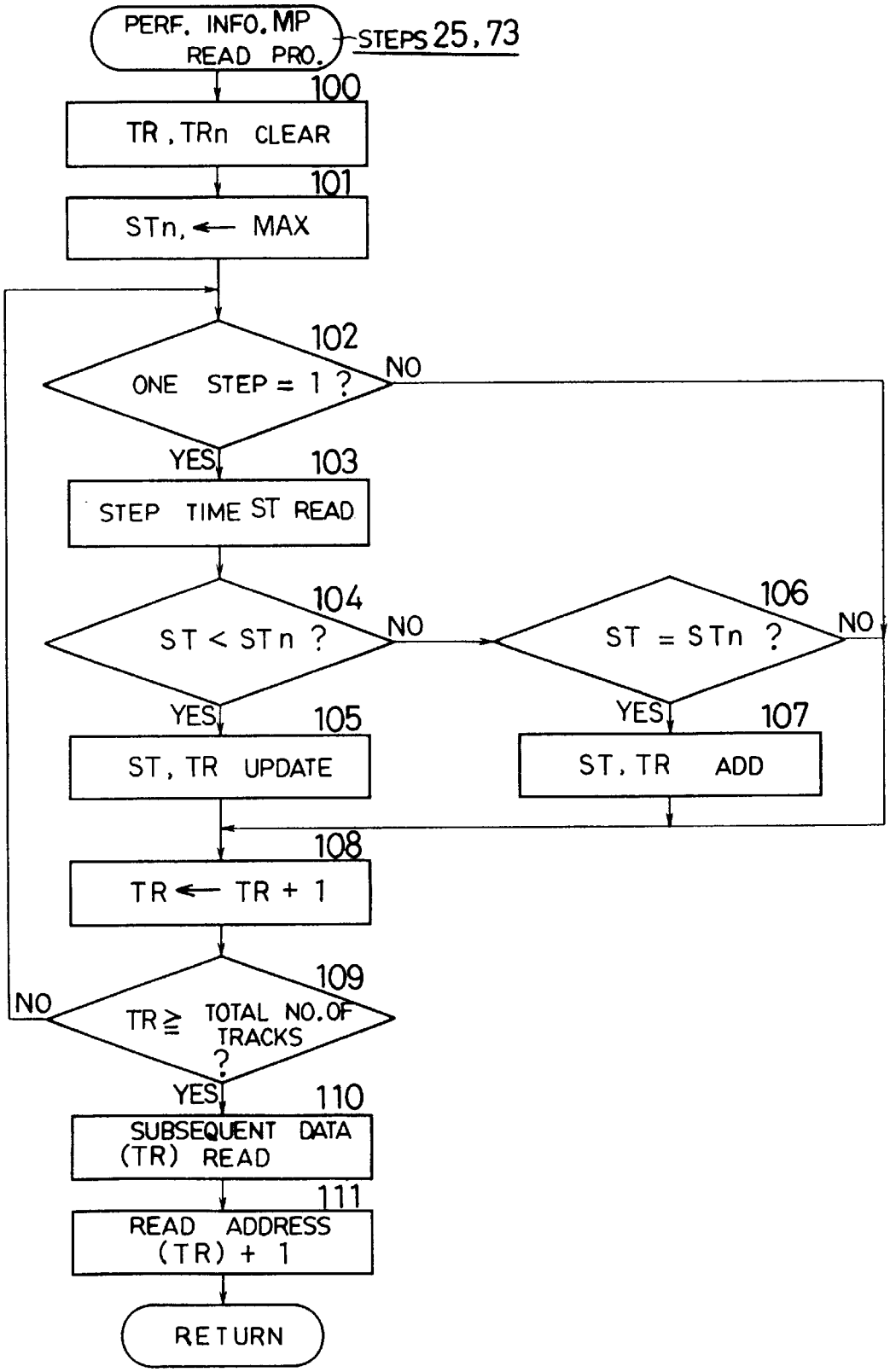
FIG. 8 is a flow chart for read processing for performance information MP, note data and related data.

FIG. 8 is a flow chart of the read processing for note data, etc. included in the performance information MP in steps 25 and 73. With this processing, the note data with step time data ST having the smallest value that is to be generated next is searched on all the tracks and detected.

First, track register 53 and track counter 54 for working memory 32 are cleared and the maximum permissible value can be stored in step register 52 (steps 100 and 101). Then, the one-step bit for mode flag register 41 is set for "1" and step time data ST in the performance information MP in tracks to be played by one-step automatic play (step 102) is read out (step 103). This read address data RA is memorized for each track in the address counter 48.

Next, the smallest step time data STn in each track (steps 108 and 109) is searched and detected (step 104). The searched step time data STn is stored in step register 52. At this point the track number TRn for track counter 54 is stored in track register 53 (step 105).

If the smallest step time data STn is detected in plural (multiple) tracks (step 106), step time data STn and track number TRn in these tracks are stored in track register 53 (step 107).

When all the tracks are thoroughly searched (steps 108 and 109), the note data, etc., is read according to the read address data RA corresponding to the searched track number TRn and stored in playback register 43 (step 110) and the read address data RA for this track increments by "1" (step 111).

In this manner, one-step automatic play for all the performance parts which are divided into each track is executed sequentially in the order of step time data ST. At this point, if the one-step bit for a certain performance part is set for "0", and the performance mode is not set for the one-step mode (step 102), this performance part is excluded from the tracks being searched and reading and/or generation of the performance information MP (note data) is prohibited.

As described above, specific performance parts are prohibited from being played by one-step performance and muted (masked). In this instance, the processing in step 102 is omitted and all of the performance parts are read out. The note data for the performance parts which are not in the one-step mode in the sound generation processing in step 72 can be used to prohibit generation/performance by tone generator 10 by either not sending it to assignment memory 31, or else attaching a mute flag to the pertinent note data and sending it to the assignment memory 31.

If the performance information MP for each performance part is not divided into plural (multiple) tracks and the part data indicating the performance part is contained in the note data, the one-step bit for mode flag register 41 is set for "1" in step 102 or in step 64, as described later, to decide whether or not the performance part to be played by one-step automatic play matches up with said part data.

During the performance parts which are muted, the manual play as in step 48 can be performed; also fully automatic play in step 11 (which will be described in a latter section) is possible. By this function, for example, it is possible to play background or rhythm by one-step automatic play, while melody or background can be played manually. Or if rhythm is played by fully automatic play, for example, melody or background (chords, bass etc.) is played by one-step automatic play. During muted performance parts, the performer can practice using manual play together with one-step automatic play.

9. One-step automatic play processing (step 10)

Figure 9:
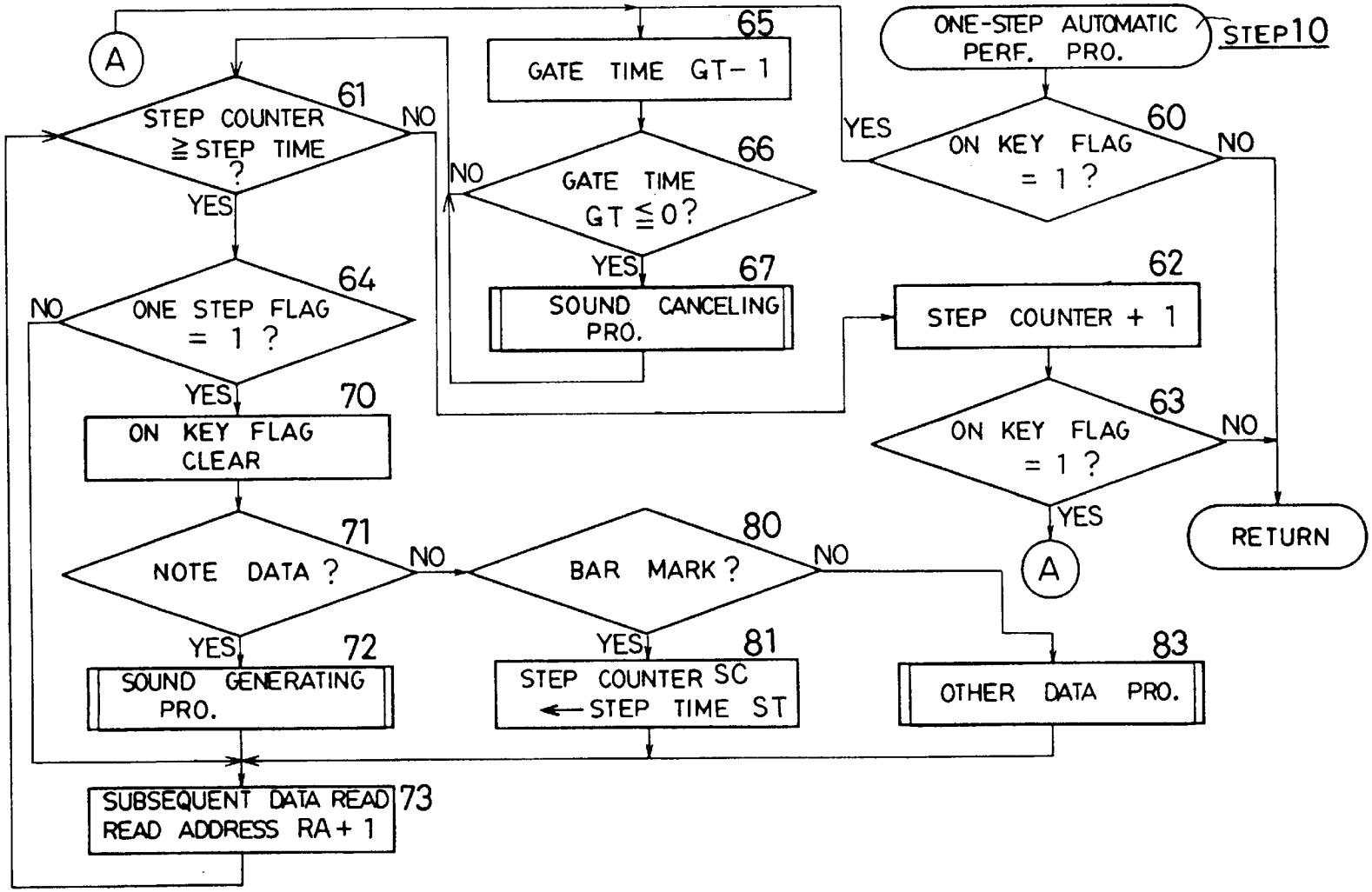
FIG. 9 is a flow chart using a different example of executing one-step automatic performance processing (step 11).

FIG. 9 is a flow chart depicting another example of the one-step automatic play processing performed in step 10 above. In this example, if step count data SC matches up with step time data ST in the step 61, only the tracks with the one step bit set for "1" (step 64) (from among the tracks to which the note data for the pertinent identical step time data ST belongs) are played by one-step automatic play (steps 70 to 83).

If said one-step bit is set for "0", the performance information MP for the pertinent track is not played by one-step automatic play (step 64). In this instance, note data, etc., read from this track is not sent to tone generator 10 (step 72).

Next, in the step 64 tracks which are not in the one-step mode are excluded, and at this point as the ON key flag is not cleared (step 70), the note data, etc., to be generated and played continuously (steps 73 and 61 to 63) is executed by one-step automatic play (steps 64 and 70 to 83). Other operation and changes are performed in the same manner as the one-step automatic play in FIG. 7, and data read processing in FIG. 8, thus the above explanation also applies.

As described above specific tracks (performance of specific performance parts) are excluded and prohibited from being played or muted (masked) during one-step automatic play. In this embodiment, read processing for note data, etc., as show in FIG. 8 is performed, however, step 102 is omitted. The processing in step 64 is also omitted and all the performance parts are read out, then in the sound generation processing in the step 72, the note data for performance parts which are not in the one-step mode is either not sent to tone generator 10 to prohibit generation/performance, or else a mute flag is added to this note data and it is sent to tone generator 10 to prohibit generation/performance. Also, if the one-step mode is not set in the step 64, the routine can jump to step 61 or else it can be returned.

10. Fully automatic play processing (step 11)

Figure 10:
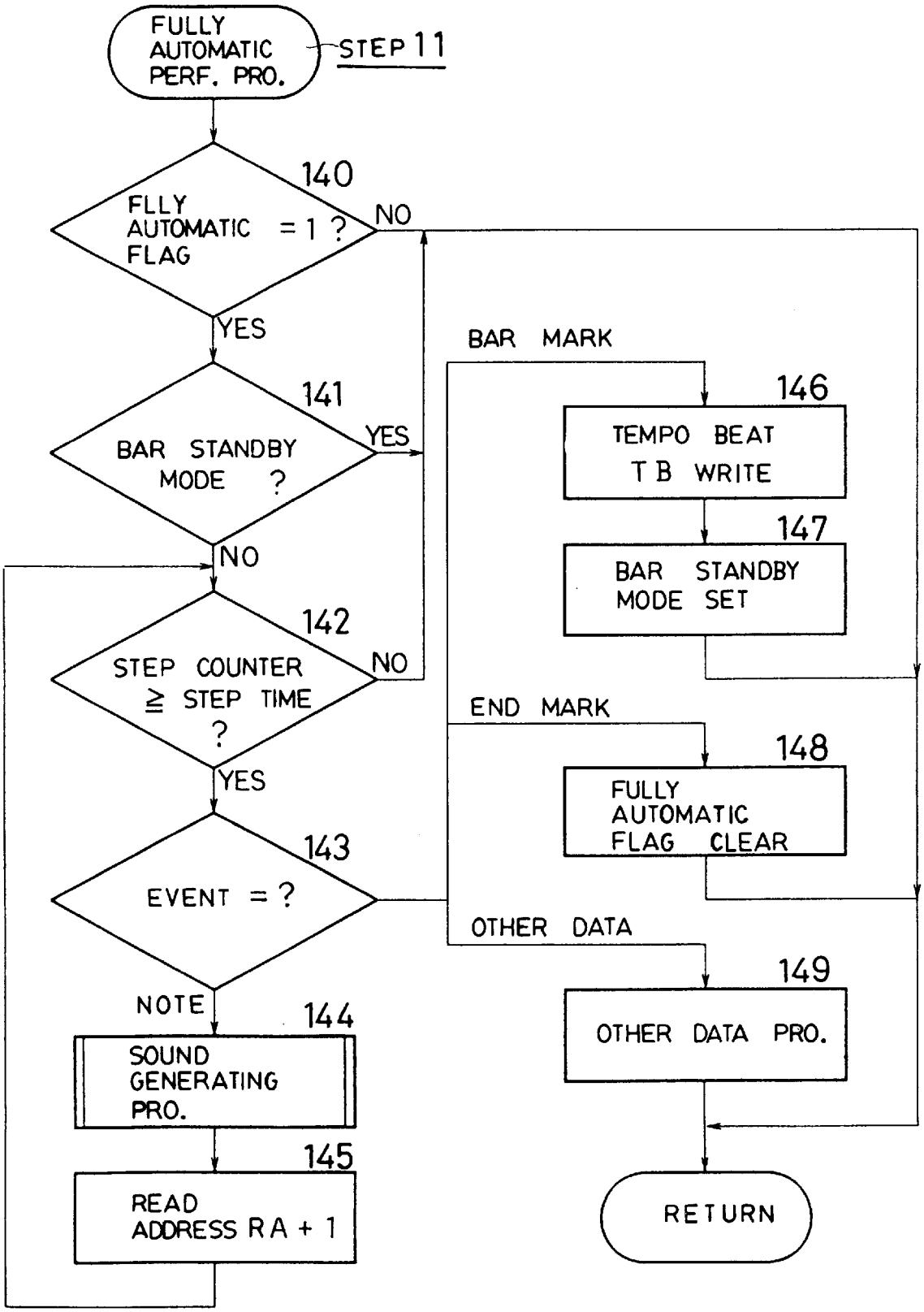
FIG. 10 is a flow chart for fully automatic performance processing (step 11).

FIG. 10 is a flow chart for the fully automatic play processing in step 11. In this processing the fully automatic bit is set for "1" and the performance information MP for performance parts in the fully automatic mode are executed automatically and sequentially in the play order as time passes.

If the fully automatic bit for the parts mode flag in mode flag register 41 is set for "1" and the fully automatic mode is set (step 140), whether or not the bar standby mode is set, is detected (step 141). If the bar standby mode is not set, whether or not the time count data TM for performance time counter 57 has reached step time data ST in playback register 43 is detected (step 142).

If the time count data TM for performance time counter 57 has reached step time data ST, the data, etc., in playback register 43 is detected (step 143). If the note data in key number data KN, etc., is detected, this note data is sent to assignment memory 31 of tone generator 10 for generation; at the same time, it is output via MIDI circuit 9 (step 144).

At this point, the tone number data TN in tone number register 45 may also be sent to assignment memory 31, whereby the tone is generated/canceled according to performance information MP, and then fully automatic play is executed. Next, the subsequent note data is read out and written in playback register 43 and then the read address data RA for read address counter 48 is incremented (step 145).

If the bar mark data BM is detected in step 143, the tempo beat data TB according to the beat data contained in the bar mark BM is written in tempo beat register 56 (step 146), and bar standby mode flag in mode register 41 is set for "1" (step 147).

If the end mark data ED is detected in step 143, the fully automatic mode for mode flag register 41 is cleared (step 148). This stops automatic play. Also, if another tone number TN, etc., is detected in the step 143, this data is stored in working memory 32 (step 149), and tone color, tempo, rhythm, etc., are changed. This fully automatic cycle interrupt processing in step 11 can also be started by pressing the start key. Whether or not the start key is pressed is detected before the step 140.

As above, manual play (step 48) and fully automatic play (step 144) can be executed together with one-step automatic play (step 72). Also, concert (soli) play using more than 1 performance in these 3 plays is enabled. If the rhythm is played by fully automatic play, for example, the background (chords, bass, etc.) can be played by one-step automatic play using the lower keyboard foot keyboard and pedals while the melody can be played manually by using the upper keyboard.

Note that the performance information MP for each performance part cannot be divided into plural (multiple) tracks. If part data indicating performance parts is included in the note data, the fully automatic bit for mode flag register 41 is set for "1" and whether or not the performance parts to be played by fully automatic play match up with the part data is determined in the step 140.

11. Fully automatic cycle interrupt processing

Figure 11:
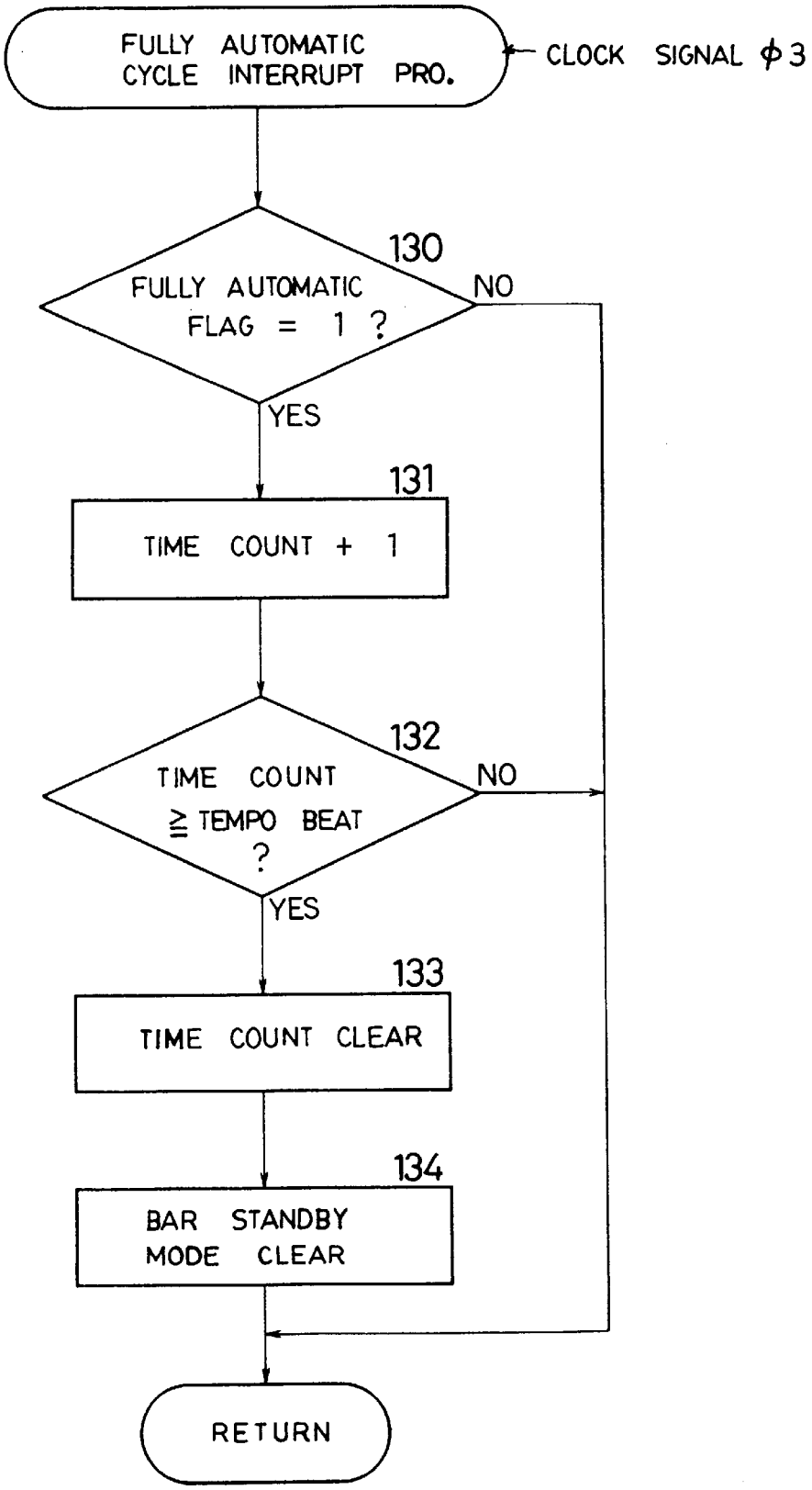
FIG. 11 is a flow chart for fully automatic performance cycle interrupt processing.

FIG. 11 is a flow chart for the fully automatic cycle interrupt processing. This processing is executed by CPU 5 each time clock signal $\phi$3 sent from the clock generator (not be shown in figures) at a fixed cycle sets to HIGH level. If the fully automatic mode is detected based on the data memorized in mode flag register 41 (step 130), the time count data TM for the play time counter 57 increments by "1" (step 131).

If the value of the time count data TM matches up with the tempo beat data TB in tempo beat register 56 (step 132), the time count data TM is cleared (step 133) and also the bar standby mode flag data in mode flag register 41 is cleared (step 134). This completes standby for one bar.

12. Simultaneous operation cycle interrupt processing

Figure 12:
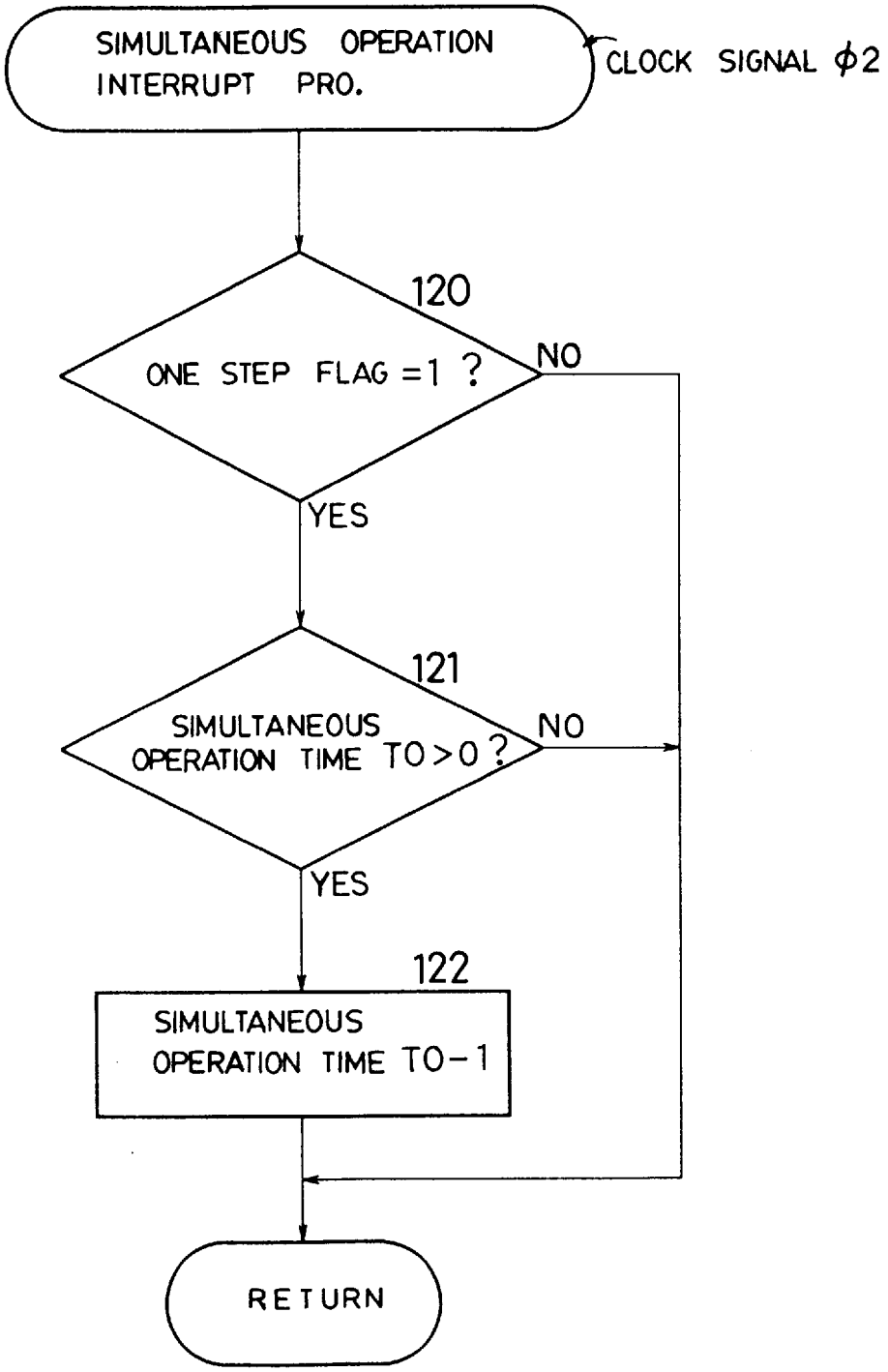
FIG. 12 is a flow chart for cycle interrupt processing for simultaneous operation.

FIG. 12 is a flow chart for the simultaneous operation cycle interrupt processing performed periodically at a fixed interval. The fixed cycle clock signal $\phi$2 from the clock generator (not be shown in figures) is supplied to CPU 5 as the interrupt signal, and this processing is executed by CPU 5 using this signal.

If the parts mode flag for mode register 41 is in the one-step mode (step 120) and the simultaneous operation time data TO for the simultaneous operation counter stored in the step 47 has not reached "0" (step 121), the simultaneous operation time data TO decrements by "1" (step 122).

As described above, one-step automatic play is prohibited until the simultaneous operation time data TO reaches "0" even if the key is set to ON (step 45, 46 and 60). This permits the performer to appear as if he were playing manually by pressing the keys simultaneously, even during one-step automatic play.

13. Initialization/reset (cancel, release) cycle interrupt processing

Figure 13:
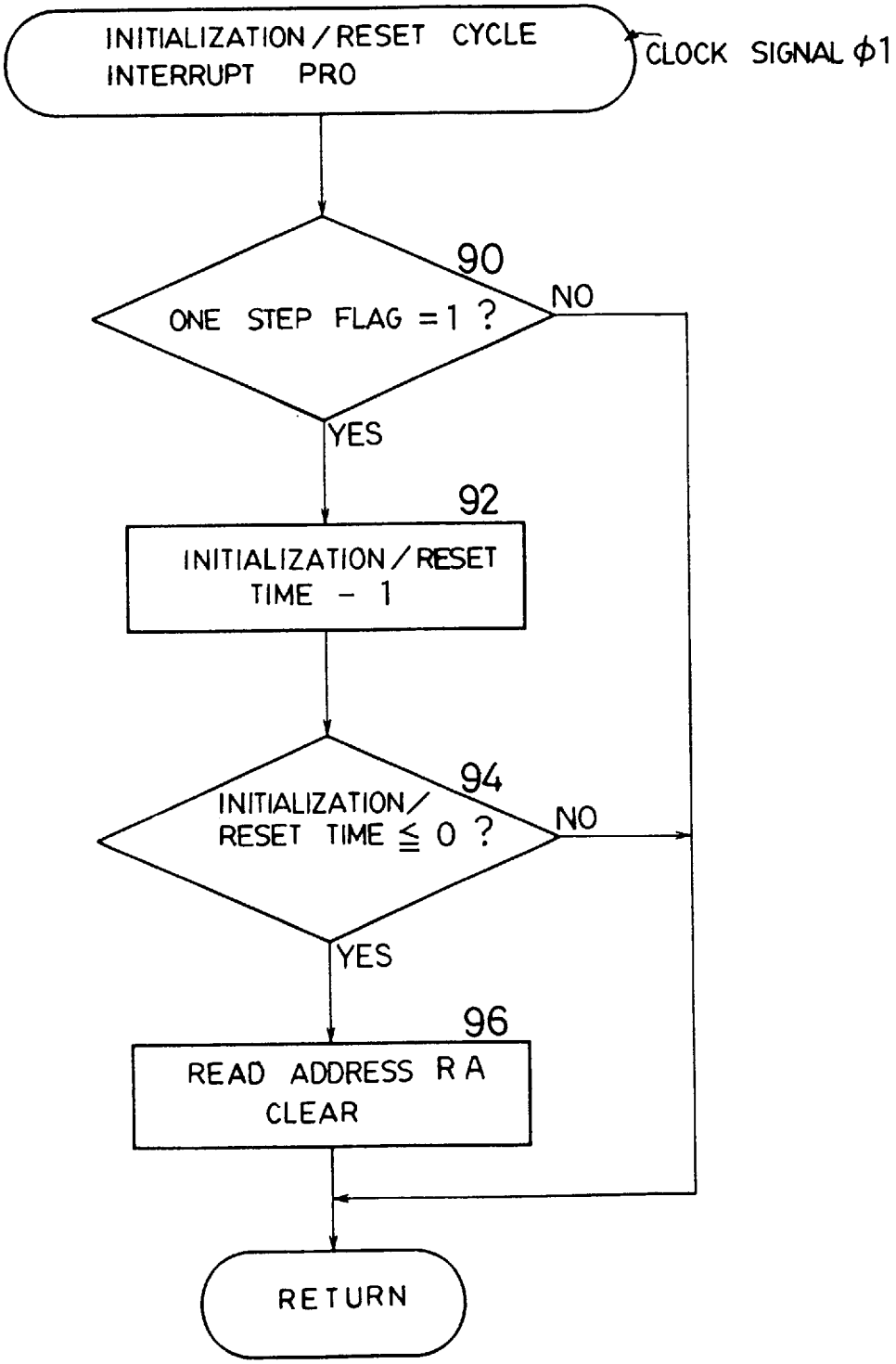
FIG. 13 is a flow chart for initialization/cancel (reset) cycle interrupt processing.

FIG. 13 is a flow chart for the periodical initialization/reset (cancel, release) cycle interrupt processing. The clock signal $\phi$1 generated from the clock generator (not illustrated in the figure) at a fixed interval is supplied to CPU 5 as the interrupt signal and this processing is executed by CPU 5 using this signal.

If the one step flag is set for "1" (step 90), the initialization/reset time data IC for reset time counter 49 is decremented until it reaches "0" (step 92). The initialization/reset time data IC decrements at a fixed interval and if the initialization/reset time data IC reaches "0" (step 94) after the specified time has elapsed, the read address data for read address counter 48 is cleared to "0" (step 96).

If the performer does not press the key to set to "ON" for a specified period of time according to the initialization/reset time data IC following the last key ON operation during one-step automatic play, the read pointer for the performance data MP returns to the beginning of the musical song (music) and one-step automatic play is initialized (reset).

Also, in this step 96, the one-step flag for mode flag register 41 can be cleared and the one-step mode is canceled to clear step count data SC for step counter 47. In this manner, one-step automatic play is reset/canceled if the key ON operation is not performed for the specified period of time.

Also, the performance data for one-step automatic play can be replaced with data such that, all the performance data MP from one simultaneous command to the next simultaneous command is read out either one time or repeatedly.

Whether or not the current simultaneous command is a simultaneous command is detected in the step 61 and the processing from steps 70 to 83 is performed repeatedly until the next simultaneous command is read out. Once the simultaneous command is read out, the read address data RA increments by "1" (in step 62); the routine does not return to step 61 and step 63 can be omitted.

In steps 92 and 122, various calculations, such as addition, multiplication and division, etc., are performed for the initialization/reset time data IC and simultaneous operation time data TO, and in steps 94 and 45 whether or not the calculated initialization/reset time data IC and the calculated simultaneous data TO have reached or exceeded the specified value can be determined. Also, for any two or all of said clock signals $\phi$1, $\phi$2 and $\phi$3 the same signal or the same cycle (sync) signal can be used. In this manner, each cycle interrupt processing can be combined.

With this invention, applications are not limited to said embodiments and various changes can be incorporated as long as the main purpose of the invention is maintained. For example, the gate time data GT indicates the duration of time for sound generation after generation is initiated. However, the gate time data GT can also be used to indicate the duration of time from the beginning of the musical song (music) or the beginning of a bar to the end of the sound generation (key OFF). In this instance, when the note data is read in the steps 25 and 73, step time data ST is deducted from the gate time data GT and stored in playback register 43. Also, step count data SC can be incremented by "4", "8", or "16" or the gate time data GT can be decremented by "4", "8" or "16" in step 62 or 65 in FIG. 7 or 9. This accelerates the processing speed.

Also, the one-step automatic play can be performed not only by each operation of the keys on keyboard 1 but also by operation of the keys in panel switch group 3, operation of switches, pedals, levers and so forth. In the step 62, note data which has the smallest amount of step time data ST is searched from among the note data stored in playback register 43, and note data in automatic play memory 8 to be generated next and the step time data ST value which was searched can be stored in step counter 47. In this way, the note data to be generated next in the performance order can be searched.

Also, one-step automatic play can be executed each time the key OFF operation is performed. In this instance, if the one-step flag is set for "1" after "Yes" is detected in the step 52, the setting of the ON key flag in the step 46 is executed. In addition if the one-step flag is set for "1" after "YES" is detected in the step 52, the initialization/reset time data IC can be stored in reset time counter 49 in the step 43. Also, the cycle for the clock signals $\phi$1, $\phi$2 and $\phi$3 can be varied depending on the set tempo. In this manner, the elapsed time from the key ON until initialization/reset in the step 96 of the cycle interrupt processing in FIG. 13, and the duration of time assumed as simultaneous operation in the step 45, the speed for fully automatic play in the steps 130 to 134 and the all tone OFF time data indicating the duration of time all tones are canceled can be varied according to the set tempo.

In addition, one-step automatic play can be performed for each track in the automatic play memory 8 (i.e., for each performance/instrument part described above). If manual play is performed using keys not included in the one-step area, the manually played parts can be excluded from the parts for one-step automatic play. In this instance, reading or performance of the corresponding tracks in the steps 25 and 73 is prohibited. Prohibition data for each track is input by the part set switch in panel switch group 3 or MIDI circuit 9 and memorized in mode flag register 41. Also, the one-step automatic play processing in FIG. 7 can also be executed each time the cycle clock signal sets to HIGH level. In this instance, the step 63 is omitted and the routine is returned after the step 62. In this manner, 1 beat timing or timing at 1/n (n=2, 3, 4. . . ) can be obtained with each key operation.

What is claimed is:

1. An automatic performance system which generates plural performance information composed of content data that indicates a content of a tone to be generated and timing data that indicates a timing at which the tone is to be generated, comprising:

detection means for detecting from among the generated plural performance information at least one item of performance information which has not been sounded yet and which has a fast sounding timing based on the timing data of the performance information and in accordance with a manual tone generation, a manual performance operation or a manual performance command; and output means for outputting the at least one item of performance information detected for sounding and excluding the output performance information from the generated plural performance information which has not yet been sounded.

2. An automatic performance system which generates plural performance information composed of content data that indicates a content of a tone to be generated and timing data that indicates a timing at which the tone is to be generated, comprising:

output means for outputting generated performance information for sounding in accordance with either a manual tone generation, a manual performance operation or a manual performance command; and selection means for selecting at least one item of performance information to be sounded next following output of the performance information based on the timing data, the selected at least one item of performance information having generally the same timing data as the output performance information.

3. The automatic performance system according to claim 1 or 2, wherein generation of the plural performance information comprises memorizing plural performance information, the content data indicating the tone content to be generated and the timing data including step time data which indicates the time from the start of music or a bar to the start of tone generation, and then reading out the memorized performance information, the manual tone generation, the manual performance operation or the manual performance command referring to the manual performance command, the automatic performance system further comprising command detection means for detecting a manual performance command and storing the detected performance command in a performance command memory, said output means sounding the performance information in accordance with the detected performance command and clearing said performance command memory in accordance with sounding of the performance information.

4. The automatic performance system according to claim 1, wherein said detection means detects based on the timing data, the at least one item of performance information which has the smallest amount of step data from among the generated plural performance information according to the manual tone generation, the manual performance operation or the manual performance command.

5. The automatic performance system according to claim 1 or 2, wherein another one of a manual tone generation, a manual performance operation or a manual performance command is performed and either a corresponding generated performance information or a manual performance information is output by said output means for a performance.

6. An automatic performance system which generates plural performance information which includes content data which indicates a content of a tone to be generated and timing data which indicates timing for generating the tone, the automatic performance system making the content data correspond to the timing data and comprising:

generation means for generating respective performance information in sequence with the timing data each time either a manual tone generation, a manual performance operation or a manual performance command is performed and outputting the generated performance information as a performance;

determination means for determining a time which has elapsed from when the manual tone generation, the manual performance operation or the manual performance command is performed; and generation control means for either initializing or canceling generation of the performance information according to the elapsed time determined by said determination means.

7. The automatic performance system according to claim 6, wherein generation of the plural performance information comprises memorizing plural performance information, the content data indicating tone content to be generated and the timing data including step time data which indicates the time from the start of music or a bar to the start of tone generation, and then reading out the memorized performance information, outputting of the performance information by said generation means comprising detecting and sounding at least one item of performance information which has not yet been sounded and which has a fast sounding timing based on the timing data of the performance information and in accordance with the manual tone generation, the manual performance operation or the manual performance command, said determination means calculating a specified value at a fixed interval and determining if the calculated value matches with the elapsed time, and said generation control means initializing the generated performance information to a beginning of the performance information and prohibiting further generation of the performance information.

8. An automatic performance system which generates plural performance information composed of content data which indicates a content of a tone to be generated and timing information which indicates a timing for when the tone is to be generated, the automatic performance system making the content data correspond to the timing information and comprising:

generation means for generating respective performance information in sequence with the timing information and assigning the performance information to tone generating channels each time one of a manual tone generation, a manual performance operation and a manual performance command is performed, a number of the tone generating channels corresponding to a maximum number of tones which are to be generated simultaneously;

detection means for detecting other ones of a manual tone generation, a manual performance operation or a manual performance command and generating operation/command information based on the detection; and assignment means for assigning the generated operation/command information to the tone generating channels.

9. The automatic performance system according to claim 8, wherein generation of the plural performance information comprises memorizing plural performance information, the content data indicating a tone content to be generated and the timing information including step time data which indicates a timing interval from the start of music or a bar to the start of tone generation for plural performance parts or instrumental parts, and then reading out the memorized performance information for each performance or instrumental part, channel assignment of the performance information comprising detecting at least one item of performance information which has not yet been sounded with a fast tone generating timing or a fast play timing based on the timing information of the performance information according to the manual tone generation, the manual performance operation or the manual performance command and assigning a channel.

10. The automatic performance system according to claim 8, further comprising:

first sound generation means for performing the manual tone generation, the manual performance operation or the manual performance command; and second sound generation means for performing the other ones of the manual tone generation, the manual performance operation or the manual performance command, the number of the tone generating channels being less than a total number of said first and second sound generation means, the automatic performance system selecting and commanding whether plural performance parts and instrumental parts should be performed by automatic play or not for each performance part and each instrumental part, said generation means prohibiting performance information for performance parts and instrumental parts which are not selected to be performed by automatic play by selection or command from being assigned to the tone generating channels, said first and second sound generation means being divided for each performance part or instrumental part, the automatic performance system generating plural performance information for making the content data correspond with the timing information, each of the generated performance information being automatically assigned to a tone generating channel in sequence with the timing information according to elapsed times, performance modes being chosen by change or selection wherein depending on the change or selection, said second sound generation means and said first sound generation means perform identically, or said generating means then terminating the channel assignment for the operation/command information and terminating the operation/command information.

11. The automatic performance system according to claim 10, wherein a specified time is determined according to the manual tone generation or the manual performance command generated by said first sound generation means or said second sound generation means, assignment of new channels being prohibited for the specified time, even if a manual tone generation or a manual performance command is performed by said first sound generation means or said second sound generation means, and sounding of the performance information being prohibited.

12. The automatic performance system according to claim 11, wherein the specified time is a time duration for simultaneous operation by said first and second sound generation means within an allowable range, determination of the specified time comprising calculating a specified value at a fixed interval and deciding if the calculated value matches with the specified time.

13. The automatic performance system according to claim 8, wherein said generation means generates respective performance information for plural performance parts and instrumental parts, the performance information being generated separately for the plural performance parts and the instrumental parts, and the respective performance information being generated as including information which indicates whether the performance information is for the plural performance parts or the instrumental parts, so as to discern each performance part from each instrumental part.

14. The automatic performance system according to claim 8, wherein at least one item of performance information containing a smallest amount of timing information from among the plural performance information is detected.

15. An automatic performance system which generates plural performance information for every plural performance part or instrumental part, the plural performance information including content data which indicates a content of a tone to be generated and timing information which indicates a timing for when the tone is to be generated, the automatic performance system making the content data correspond to the timing information and comprising:

generation means for generating respective performance information in sequence with the timing information for each of a manual tone generation, a manual performance operation or a manual performance command and outputting the respective performance information as a performance;

selection means for selecting whether or not the generated respective performance information is sounded separately for each performance part or each instrumental part for each of the manual tone generation, the manual performance operation or the manual performance command; and prohibition means for prohibiting generation of performance information for performance parts that are not selected to be sounded in accordance with said selection means.

16. An automatic performance system which generates plural performance information separately for plural performance parts or instrumental parts, the plural performance information including content data which indicates a content of a tone to be generated and timing information which indicates a timing for the tone to be generated, the automatic performance system making the content data correspond to the timing information and comprising:

selection means for selecting between fully automatic performance, one-step automatic performance and manual performance for respective performance parts and instrumental parts; and generation means for generating, if fully automatic performance is selected by said selection means, respective performance information for either the performance parts or the instrumental parts selected for fully automatic performance and executing the respective performance information in sequence with the timing information corresponding to elapsed time, said generation means generating, if one-step automatic performance is selected by said selection means, respective performance information for either the performance parts or the instrumental parts selected for one-step automatic performance and executing the respective performance information in sequence with the timing information for each of a manual tone generation, a manual performance operation or a manual performance command, and said generation means generating, if manual performance is selected by said selection means, respective performance information and executing the respective performance information according to either the performance parts or the instrumental parts, and also according to the manual tone generation, the manual performance operation or the manual performance command.

17. The automatic performance system according to claim 16, wherein generation of the plural performance information comprises memorizing plural performance information, the content data indicating tone content to be generated and the timing information including step time data which indicates a timing interval from the start of music or a bar to the start of tone generation for the plural performance parts or the instrumental parts, and reading out the memorized performance information separately for the respective performance parts or the instrument parts, the automatic performance system further comprising:

output means for outputting the performance information, outputting of performance information comprising detecting and outputting at least one item of performance information which has not yet been sounded and which has a fast sounding or play timing based on the timing data for the performance information and in accordance with the manual tone generation, the manual performance operation or the manual performance command, said generation means further generating subsequent performance information if the performance information generated according to the manual tone generation, the manual performance operation or the manual performance command is for fully automatic performance or manual performance and then executing the subsequent performance information, said generation means generation, performance operation or performance command being separated into plural performance and instrumental parts, two or more of said plural performance parts and instrumental parts being identical in accordance with said selection means for selecting performance mode.

18. The automatic performance system according to claim 15, wherein a specified time is determined based on each of the manual tone generation, the manual performance operation or the manual performance command, outputting of performance information within the specified time being prohibited, even if the manual tone generation, the manual performance operation or the manual performance command is performed.

19. The automatic performance system according to claim 18, wherein the specified time comprises a time duration for simultaneous operation of the manual tone generation, the manual performance operation or the manual performance command for performance within an allowable range, determination of the specified time comprising calculating a specified value at a fixed time interval to determine if the calculated value matches with the specified time.

20. The automatic performance system according to claim 15 or 16, wherein generation of the plural performance information comprises generating each performance information for the plural performance parts and the instrumental parts, the performance information being generated separately for the performance parts and the instrumental parts;

the respective performance information being generated as including information which indicates whether the performance information is for the plural performance parts or the instrumental parts, so as to discern the respective performance and instrumental parts.

21. The automatic performance system according to claim 15 or 16, wherein at least one item of performance information containing a smallest amount of timing information is selected from among the generated plural performance information.

22. The automatic performance system according to claim 16, wherein performance information for manual performance is generated according to the manual tone generation, the manual performance operation or the manual performance command for other tones.

23. An automatic performance system which generates plural performance information including content data indicating a content of a tone to be generated, timing information which indicates a timing for when the tone is to be generated, and continuous information which indicates a time duration that generation of the tone continues, the automatic performance system making the content data correspond to both the timing information and the continuous information and comprising:

generation means for starting generation of the respective performance information in sequence with the timing information for each of a manual tone generation, a manual performance operation or a manual performance command;

determination means for determining which performance information to cancel before starting of generation of a next performance information from among the plural performance information according to the manual tone generation, the manual performance operation or the manual performance command based on the continuous information; and control means for canceling generation of the respective performance information that has been started according to the determination by said determination means.

24. The automatic performance system according to claim 23, wherein generation of the plural performance information comprises memorizing plural performance information, the content data indicating a tone content to be generated and the timing information including step time data which indicates a timing interval from the start of a musical selection or a bar to the start of tone generation for plural performance parts or instrumental parts, and then reading out the memorized performance information for each performance or instrumental part, starting of generation of the performance information comprising generating at least one performance information to be sounded following the respective performance information generated at starting by said generation means and which has almost identical timing information, and calculating a first specified value repeatedly to determine whether the first specified value matches with a value which corresponds to elapsed time based on the timing information and generating the respective performance information in sequence with the timing information, said determination means calculating a second specified value repeatedly until the next performance information is detected and output, and determining whether the second specified value matches with the value which corresponds to the elapsed time based on the continuous information to determine which performance information should be canceled before generation of the next performance information starts, said control means canceling sounding for the respective performance information which has already begun by changing the respective performance information which is in a key ON state to a key OFF state, said first and second specified values being identical, calculations according to the timing information and calculations according to the continuous information being executed at the same timing speed, the automatic performance system detecting if all or part of the manual tone generation, the manual performance operation or the manual performance command is in the sound canceling state and starting or canceling generation of all the performance information according to the results of the detection.

25. The automatic performance system according to claim 23, a specified time being determined according to the manual tone generation, the manual performance operation or the manual performance command, output of the performance information being prohibited for the specified time even if the manual tone generation, the manual performance operation or the manual performance command is performed.

26. The automatic performance system according to claim 25, wherein determination of the specified time consists of determining a time duration for simultaneous operation of the manual tone generation, the manual performance operation or the manual performance command within an allowable range and calculating a specified value at a fixed interval and determining if the specified value matches with the specified time.

27. The automatic performance system according to claim 23, wherein generation of the plural performance information consists of memorizing plural performance information for plural performance parts and instrumental parts, said generation means being separated into performance parts or instrumental parts, the automatic performance system selecting whether or not to generate the respective performance parts or instrumental parts included in the generated respective performance information, and prohibiting generation of the performance information for the performance parts which are not selected to be generated.

28. The automatic performance system according to claim 23, wherein generation of the plural performance information consists of memorizing plural performance information for plural performance parts and instrumental parts, the performance information being generated or memorized separately for performance and instrumental parts so as to discern each performance part from each instrumental part.

29. The automatic performance system according to claim 23, wherein at least one item of performance information which has a smallest amount of timing information is detected from among the generated plural performance information.

30. The automatic performance system according to claim 23, wherein performance information for manual play is output according to a manual tone generation, a manual performance operation or a manual performance command for other tones.

31. The automatic performance system according to claim 24, wherein detection of the sound canceling state consists of calculating a specified value at a fixed interval after all or part of the manual tone generation, the manual performance operation or the manual performance command is set for the sound canceling state, and detecting if the specified value is a value which corresponds with time.

32. The automatic performance system according to claims 1, 2, 6, 8, 15, 16 or 23, comprising programs which are memorized on memory media devices.

* * * * *